US012377516B2

(12) United States Patent
Kashiwagi

(10) Patent No.: US 12,377,516 B2
(45) Date of Patent: Aug. 5, 2025

(54) POLISHING HEAD AND POLISHING APPARATUS

(71) Applicant: EBARA CORPORATION, Tokyo (JP)

(72) Inventor: Makoto Kashiwagi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 363 days.

(21) Appl. No.: 17/796,844

(22) PCT Filed: Jan. 7, 2021

(86) PCT No.: PCT/JP2021/000326
§ 371 (c)(1),
(2) Date: Aug. 1, 2022

(87) PCT Pub. No.: WO2021/157276
PCT Pub. Date: Aug. 12, 2021

(65) Prior Publication Data

US 2023/0055770 A1 Feb. 23, 2023

(30) Foreign Application Priority Data

Feb. 5, 2020 (JP) ..... 2020-018043

(51) Int. Cl.
*B24B 41/00* (2006.01)
*B24B 41/047* (2006.01)

(52) U.S. Cl.
CPC ..... *B24B 41/002* (2013.01); *B24B 41/047* (2013.01)

(58) Field of Classification Search
CPC ..... B24B 37/02; B24B 37/04; B24B 37/30; B24B 41/047; B24B 41/002; B24B 41/04;
(Continued)

(56) References Cited

U.S. PATENT DOCUMENTS 5,179,805 A * 1/1993 Numao ..... B24B 21/16 451/313
8,517,804 B2 * 8/2013 Weigmann ..... B24B 21/02 451/317

(Continued)

FOREIGN PATENT DOCUMENTS

CN 101687305 A 3/2010
CN 102971111 A 3/2013

(Continued)

OTHER PUBLICATIONS

Translation of JP_2018094715_A_H (Year: 2024).*

(Continued)

*Primary Examiner* — Edward F Landrum
*Assistant Examiner* — Sarah Akyaa Fordjour
(74) *Attorney, Agent, or Firm* — BakerHostetler

(57) ABSTRACT

The disclosed subject matter relates to a polishing head for pressing a polishing tool against a substrate, such as a wafer. Further, the disclosed subject matter relates to a polishing apparatus for polishing a substrate with such a polishing head. A polishing head includes an annular elastic member configured to press a polishing tool against the substrate, and a pressing-tool body having a pressing surface configured to press the polishing tool against the substrate via the elastic member, wherein the pressing surface has a first fitting groove in which a first portion of the elastic member fits, the first portion (41) protrudes from the pressing surface, the elastic member is put on the pressing-tool body (43) with the elastic member elastically deformed, and the polishing head is configured to press the polishing tool against the substrate by the first portion.

14 Claims, 26 Drawing Sheets

(58) Field of Classification Search
CPC ..... B24B 47/14; B24B 49/12; B24B 7/228; B24B 9/065; B24B 21/16; B24B 21/22; B24B 1/04; B24B 23/03; B24B 21/00; B24B 21/08
USPC ..... 451/303, 288
See application file for complete search history.

(56) References Cited

U.S. PATENT DOCUMENTS

| | | | | |
|---|---|---|---|---|
| 10,403,505 | B2 | 9/2019 | Ito et al. | |
| 2009/0017733 | A1 | 1/2009 | Takahashi et al. | |
| 2014/0094099 | A1* | 4/2014 | Hildebrandt | B24B 21/06 451/303 |
| 2018/0117730 | A1* | 5/2018 | Nabeya | B24B 37/32 |
| 2019/0054594 | A1 | 2/2019 | Nakanishi et al. | |
| 2019/0184519 | A1 | 6/2019 | Kashiwagi et al. | |

FOREIGN PATENT DOCUMENTS

| | | | | | |
|---|---|---|---|---|---|
| CN | 205363544 | U | | 7/2016 | |
| CN | 110026868 | A | | 7/2019 | |
| CN | 110091237 | A | | 8/2019 | |
| EP | 2586567 | A2 | | 5/2013 | |
| JP | S63-300855 | A | | 12/1988 | |
| JP | 08141904 | A | * | 6/1996 | |
| JP | H08-141904 | A | | 6/1996 | |
| JP | 2003-071690 | A | | 3/2003 | |
| JP | 2011062806 | A | * | 3/2011 | |
| JP | 2011-161625 | A | | 8/2011 | |
| JP | 2018094715 | A | * | 6/2018 | B24B 21/002 |
| JP | 2019-077003 | A | | 5/2019 | |
| JP | 2019-107752 | A | | 7/2019 | |

OTHER PUBLICATIONS

Translation of JP_H08141904_A_H. (Year: 2024).*
Translation of JP2011062806 (Year: 2025).*
European Patent Application No. 21750510.6; Extended Search Report; dated Jan. 2, 2024; 7 pages.
International Patent Application No. PCT/JP2021/000326; dated Mar. 30, 2021; 4 pages.

* cited by examiner

POLISHING HEAD AND POLISHING APPARATUS

TECHNICAL FIELD

The present invention relates to a polishing head for pressing a polishing tool against a substrate, such as a wafer. Further, the present invention relates to a polishing apparatus for polishing a substrate with such a polishing head.

BACKGROUND ART

Devices, such as memory circuits, logic circuits and image sensors (e.g., CMOS sensors) are becoming more highly integrated these days. In a process for forming such devices on a substrate, such as a wafer, foreign matter, such as fine particles, dust, and unwanted film, may adhere to the substrate. Foreign matter adhering to the substrate can cause detects, such as a manufacturing failure and breakage of a device. Therefore, in order to enhance the reliability of the device, it is necessary to remove the foreign matter on the substrate.

In order to remove the foreign matter on the substrate, such as a wafer, there is a polishing apparatus configured to polish the substrate using a polishing tool. One type of such a polishing apparatus is configured to polish the substrate by rubbing a polishing tool against the substrate. The polishing apparatus presses the polishing tool against the substrate by a polishing head to polish the substrate.

CITATION LIST

Patent Literature

Patent document 1: Japanese laid-open patent publication No. 2011-161625

Patent document 2: Japanese laid-open patent publication No. 2019-107752

SUMMARY OF INVENTION

Technical Problem

An example of the polishing apparatus includes a polishing apparatus configured to polish a substrate by pressing a polishing tool against the substrate by a polishing head, while rotating, the substrate and feeding the polishing tool, such as a polishing tape, in one direction. The polishing head of this polishing apparatus includes a pressing tool configured to press the polishing tool against the substrate. However, due to a machining accuracy limit of the pressing tool, a contact surface of the pressing tool being in contact with the polishing tool may have irregularities, and a smooth contact surface may not be obtained. The contact surface that is not smooth may cause a variation in pressing force of the polishing tool against the substrate and may cause a region where the polishing tool does not contact the substrate. As a result, a desired polishing performance may not be obtained.

Thus, the present invention provides a polishing head capable of pressing a polishing tool against a substrate with a uniform force. Further, the present invention provides a polishing apparatus including such a polishing head.

Solution to Problem

In an embodiment, there is provided a polishing head for polishing a substrate, comprising: an annular elastic member configured to press a polishing tool against the substrate; and a pressing-tool body having a pressing surface configured to press the polishing tool against the substrate via the elastic member, wherein the pressing surface has a first fitting groove in which a first portion of the elastic member fits, the first portion protrudes from the pressing surface, the elastic member is put on the pressing-tool body with the elastic member elastically deformed, and the polishing head is configured to press the polishing tool against the substrate by the first portion.

In an embodiment, the elastic member is detachably put on the pressing-tool body.

In an embodiment, the elastic member has a circular cross section.

In an embodiment, the elastic member is covered with a coating layer containing a fluororesin.

In an embodiment, the pressing-tool body further has a tapered surface extending obliquely from the pressing surface.

In an embodiment, a side surface of the pressing-tool body has a second fitting groove in which a second portion of the elastic member fits.

In an embodiment, the pressing-tool body has a protrusion on a side surface of the pressing-tool body, and the protrusion supports the elastic member.

In an embodiment, the first fitting groove comprises a plurality of first fitting grooves located away from each other, and the first portion comprises a plurality of first portions fitting in the plurality of first fitting grooves, respectively.

In an embodiment, the first fitting groove has an arc shape having the same curvature as a curvature of the substrate.

In an embodiment, there is provided a polishing apparatus comprising: a substrate holder configured to hold a substrate; and the above-mentioned polishing head configured to press a polishing tool against the substrate to polish the substrate.

Advantageous Effects of Invention

According to the present invention, the polishing head includes the annular elastic member for pressing the polishing tool against the substrate. Tension is applied to the elastic member, and the elastic member is put on the pressing-tool body with the elastic member elastically deformed, while the elastic member fits in the fitting groove. As a result, a contact surface of the elastic member with the polishing tool is stretched and smoothed. Therefore, the polishing head can press the polishing, tool against the substrate with a uniform force.

DESCRIPTION OF EMBODIMENTS

Figure 1:
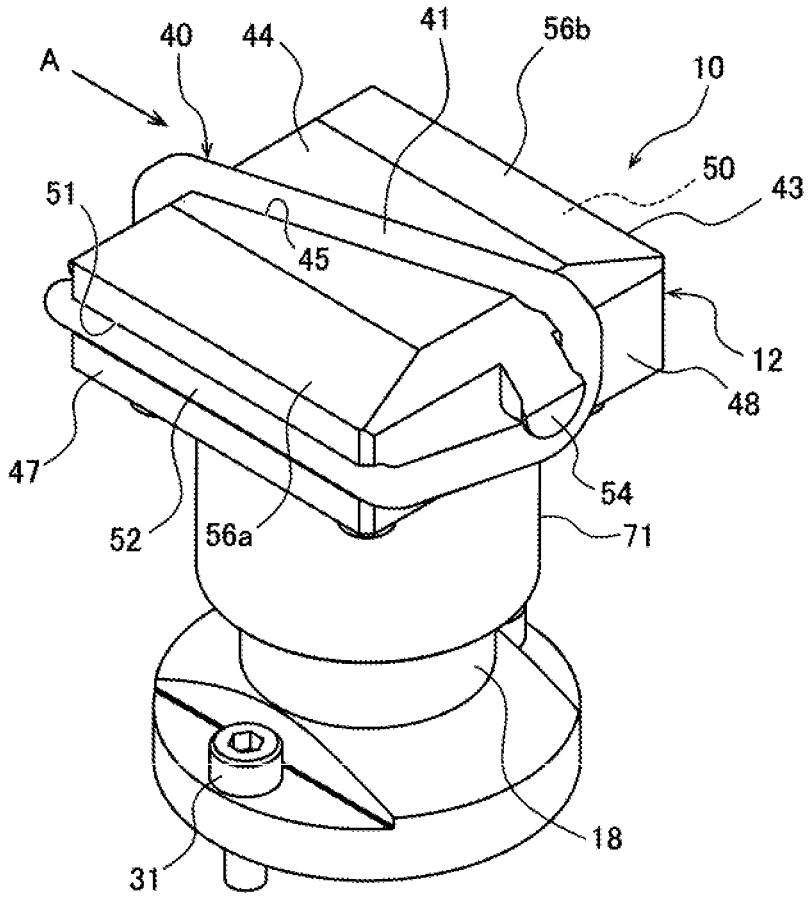
FIG. 1 is a perspective view showing a polishing head configured to polish a wafer by pressing a polishing tape, which is an example of a polishing tool, against a surface of the wafer, which is an example of a substrate.

Embodiments of the present invention will now be described with reference to the drawing.

Figure 2:
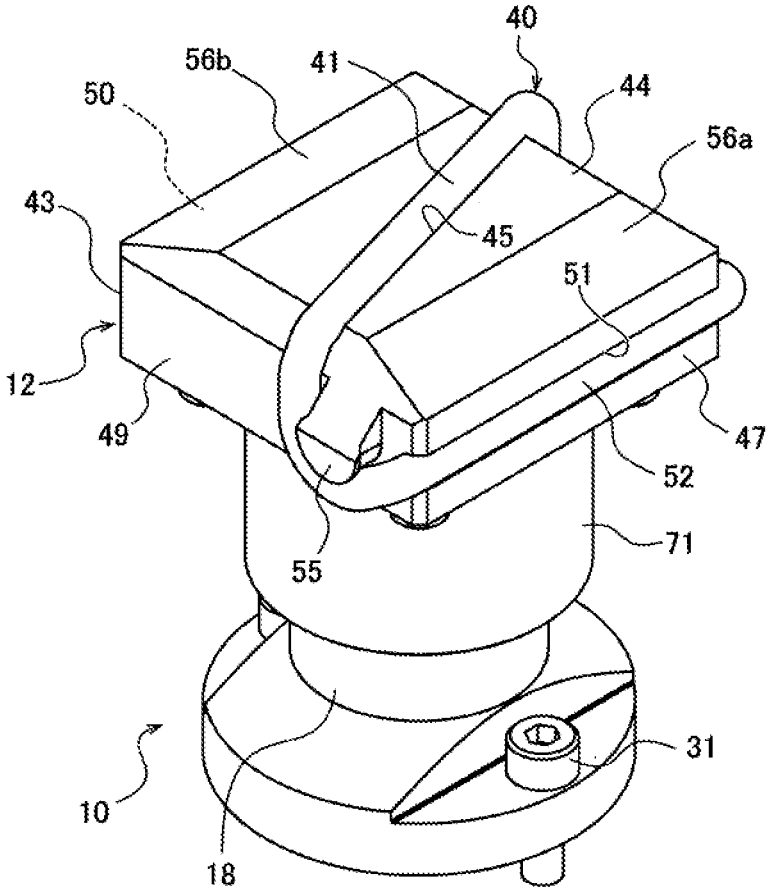
FIG. 2 is a diagram showing the polishing head shown in FIG. 1 as viewed from a direction indicated by an arrow A in FIG. 1.
Figure 3:
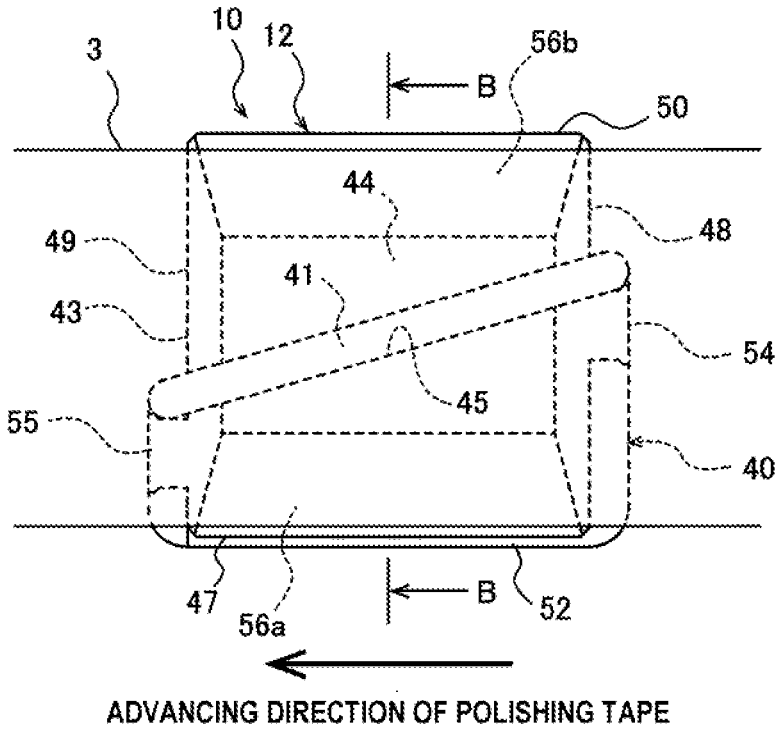
FIG. 3 is a plan view of the polishing head.
Figure 4:
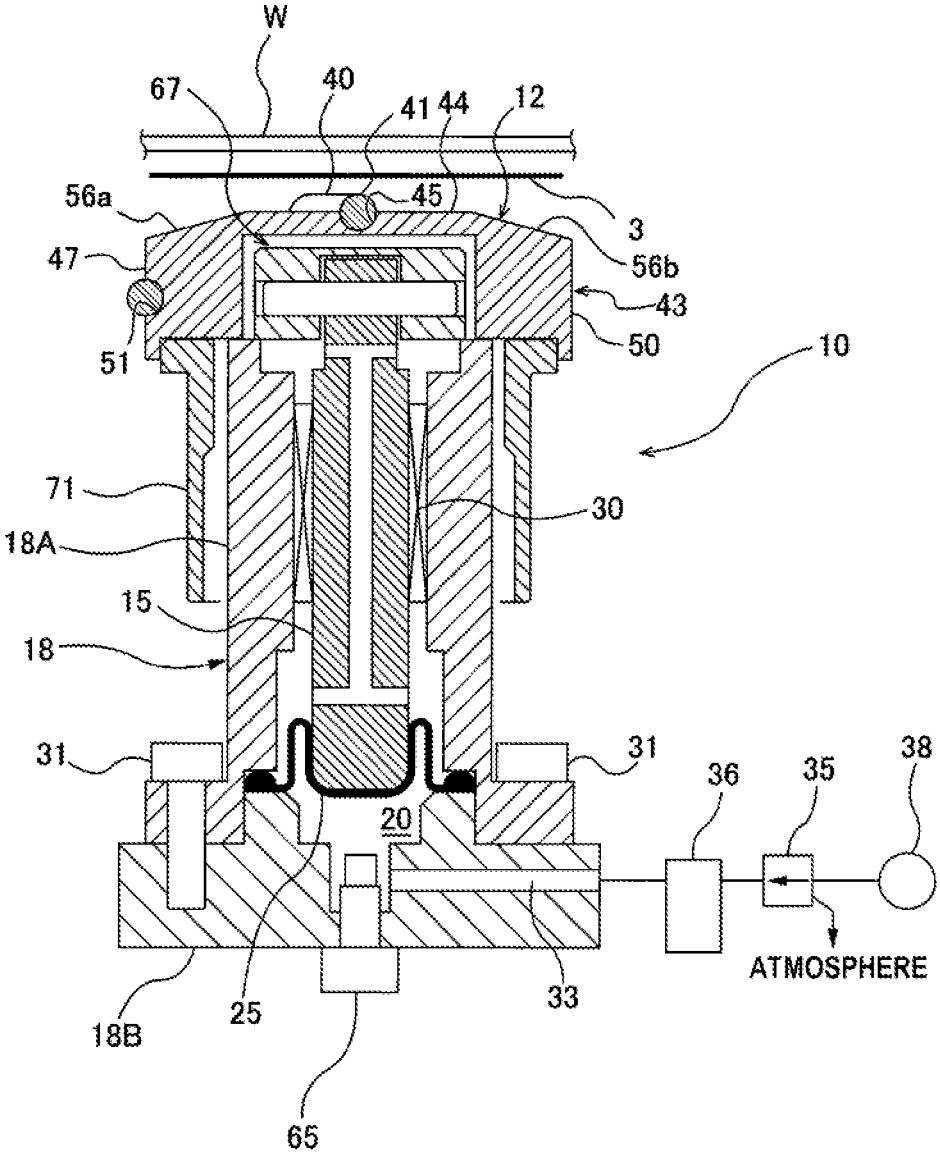
FIG. 4 is a cross-sectional view taken along a line B-B in FIG. 3.

FIG. 1 is a perspective view showing a polishing head configured to polish a wafer by pressing a polishing tape, which is an example of a polishing tool, against a surface of the wafer, which is an example of a substrate. FIG. 2 is a diagram showing the polishing head shown in FIG. 1 as viewed from a direction indicated by an arrow A in FIG. 1. FIG. 3 is a plan view of the polishing head. FIG. 4 is a cross-sectional taken along a line B-B in FIG. 3. As shown in FIG. 4, a polishing head 10 of the present embodiment is disposed below a wafer W and a polishing tape 3. In FIGS. 1 and 2, the wafer W and the polishing tape 3 are not depicted.

As shown in FIG. 4, the polishing head 10 includes a pressing tool 12 configured to press the polishing tape 3 against the wafer W, a movable shaft 15 coupled to the pressing tool 12, a housing 18 configured to house the movable shaft 15 therein, and a partition membrane (or diaphragm) 25 configured to form a pressure chamber 20 between an end portion of the movable shaft 15 and the housing 18. The pressing tool 12 includes an annular elastic member 40 configured to press the polishing tape 3 against the wafer W, and a pressing-tool body 43 configured to support the elastic member 40.

As shown in FIGS. 1 to 4, the pressing-tool body 43 has a pressing surface 44 configured to press the polishing tape 3 against the wafer W via the elastic member 40. The pressing surface 44 has a fitting groove 45 in which the elastic member 40 fits. The elastic member 40 is put on the pressing-tool body 43 with the elastic member 40 elastically deformed, while the elastic member 40 fits in the fitting groove 45. The elastic member 40 has a portion 41 fitting in the fitting groove 45. A thickness of the elastic member 40 is larger than a depth of the fitting groove 45, and thus the portion 41 of the elastic member 40 protrudes from the pressing surface 44.

The movable shaft 15 is movable in an axial direction thereof in the housing 18, and the movable shaft 15 can elevate the pressing tool 12. The pressing surface 44 faces a back surface of the polishing tape 3. When the movable shaft 15 elevates the pressing tool 12, the portion 41 of the elastic member 40 is brought into contact with the back surface of the polishing tape 3. During polishing of the wafer W, the elastic member 40 presses a polishing surface of the polishing tape 3 against a lower surface of the wafer W. The back surface of the polishing tape 3 is supported by the elastic member 40. The back surface of the polishing tape 3 is an opposite side of the polishing tape 3 from the polishing surface having abrasive grains. During the polishing of the wafer W, the polishing tape 3 is advanced with a predetermined speed. As shown in FIG. 3, the portion 41 of the elastic member 40 and the fitting groove 45 are inclined obliquely with respect to an advancing direction of the polishing tape 3. Angles of the portion 41 of the elastic member 40 and the fitting groove 45 with respect to the advancing direction of the polishing tape 3 are not limited to the embodiment shown in FIG. 3.

The elastic member 40 is made of a flexible material. Examples of the material constituting the elastic member 40 include rubbers, such as fluoro-rubber, silicone rubber, ethylene propylene diene rubber, or the like. A cross section of the elastic member 40 has a circular shape. The elastic member 40 may be an O-ring. A diameter of the elastic member 40 may preferably be in a range of 1.0 mm to 10 mm.

Figure 5:
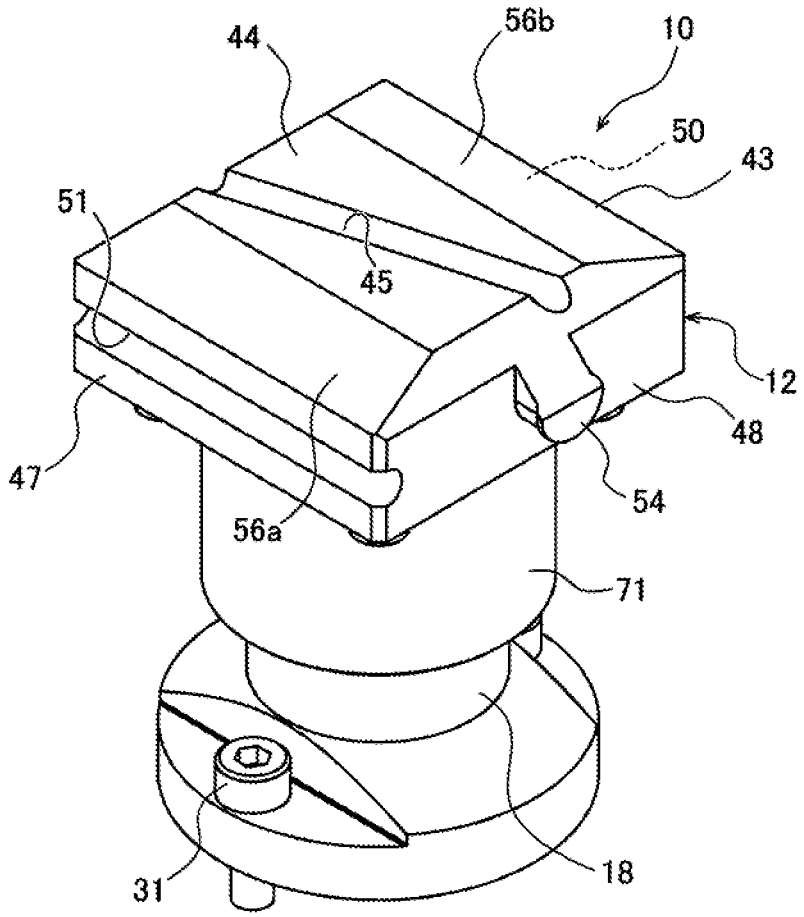
FIG. 5 is a diagram showing a pressing-tool body from which an elastic member has been removed.

The elastic member 40 is detachably put on the pressing-tool body 43. FIG. 5 is a diagram showing the pressing-tool body 43 from which the elastic member 40 has been removed. The fitting groove 45 extends straight across the pressing surface 44, and a cross section of the fitting groove 45 has an arc shape. The elastic member 40 is secured to the pressing-tool body 43 by putting the elastic member 40 on the pressing-tool body 43 while fitting the elastic member 40 in the fitting groove 45 and stretching the elastic member 40.

When the elastic member 40 is supported on the pressing-tool body 43 with the elastic member 40 elastically deformed, a tension is applied to the elastic member 40. A radius of curvature of the cross section of the fitting groove 45 is smaller than a radius of the cross section of the elastic member 40 when the elastic member 40 is not elastically deformed. Therefore, the portion 41 of the elastic member 40 is in tight contact with a surface of the fitting groove 45 and is fixed in the fitting groove 45. As a result, the elastic member 40 is secured stably to the pressing-tool body 43.

In one embodiment, the cross-sectional shape of the elastic member 40 may be a polygon, such as a quadrangle or a hexagon, or a shape having an arc shape in a part of the cross section. The cross-sectional shape of the fitting groove 45 is not limited to the arc shape. In one embodiment, the cross section of the fitting groove 45 may have a rectangular shape.

When the elastic member 40 is held on the pressing-tool body 43, the elastic member 40 is stretched, so that a contact surface of the elastic member 40, which is to be brought into contact with the polishing tape 3, is stretched and becomes smooth. As a result, the polishing head 10 can press the polishing tape 3 against the wafer W with a uniform force. Furthermore, since the elastic member 40 is in tight contact with the surface of the fitting groove 45 and is secured in the fitting groove 45, the position of the elastic member 40 relative to the pressing-tool body 43 is not changed during the polishing of the wafer W.

The elastic member 40 is not fixed to the pressing-tool body 43 with a fixing tool, such as a screw, but is simply put on the pressing-tool body 43. Therefore, when the elastic member 40 is deteriorated by the polishing, only the elastic member 40 can be easily replaced. As a result, the replacement work for the deteriorated member can be performed easily, and a cost of part replacement can be reduced.

Even if the portion 41 of the elastic member 40 is deteriorated by the polishing, one elastic member 40 can be reused multiple times by replacing a portion of the elastic member 40 fitting in the fitting groove 45 from one to anther within the same elastic member 40. Therefore, a service life of the elastic member 40 can be extended, and the cost of part replacement can be further reduced.

As shown in FIGS. 1 to 3, the entire elastic member 40 surrounds the pressing-tool body 43. The elastic member 40 is put only on the pressing surface 44 and side surfaces of the pressing-tool body 43, and the elastic member 40 does not present on a back side of the pressing-tool body 43. Therefore, an operator can easily remove only the elastic member 40 without removing the pressing-tool body 43 from the polishing head 10. In one embodiment, the elastic member 40 may be put on an opposite side (back side) of the pressing-tool body 43 from the pressing surface 44, but the configuration in which the elastic member 40 is put on the pressing-tool body 43 without putting on the back side of the pressing-tool body 43, can make the replacement of the elastic member 40 easier.

The pressing-tool body 43 of the present embodiment has a fitting groove 51 formed in a side surface of the pressing-tool body 43, and the elastic member 40 fits in the fitting groove 51. Specifically, the pressing-tool body 43 has the fitting move 51 in a side surface 47. The fitting groove 51 extends straight across the side surface 47, and a cross section of the fitting groove 51 has an arc shape. Details of the fitting groove 51, which will not be particularly described, are the same as those of the above-described fitting groove 45, and duplicated descriptions will be omitted. The elastic member 40 of the present embodiment is put on the pressing-tool body 43 with the elastic member 40 elastically deformed, while the elastic member 40 fits in the fitting groove 51. The elastic member 40 has a portion 52 fitting in the fitting groove 51. The portion 52 of the elastic member 40 is in tight contact with a surface of the fitting groove 51 and is secured in the fitting groove 51. As a result, the elastic member 40 is secured more stably to the pressing-tool body 43.

The pressing-tool body 43 of the present embodiment has protrusions 54 and 55 on side surfaces of the pressing-tool body 43. Specifically, the protrusion 54 is fixed to a side surface 48, and the protrusion 55 is fixed to a side surface 49 which is an opposite side from the side surface 48. In the present embodiment, the elastic member 40 is put on the protrusions 54 and 55 with the elastic member 40 elastically deformed, and the elastic member 40 is further supported by the protrusions 54 and 55. As a result, the elastic member 40 is secured more stably to the pressing-tool body 43. In one embodiment, the protrusion 54 may be integrally formed with the side surface 48, and the protrusion 55 may be integrally formed with the side surface 49.

In one embodiment, the side surface 47 of the pressing-tool body 43 may not have the fitting groove 51. Even if the side surface 47 does not have the fitting groove 51, the elastic member 40 can be secured stably to the pressing-tool body 43 when the elastic member 40 is put on the protrusions 54 and 55. Further, in one embodiment, a protrusion capable of supporting the elastic member 40 may be fixed to the side surface 47. In this case, the side surface 47 may not have the fitting groove 51.

In one embodiment, the pressing-tool body 43 may include only one of the protrusions 54 and 55. Further, in one embodiment, the pressing-tool body 43 may have a fitting groove, in which the elastic member 40 fits, in the side surface 49 and/or the side surface 48. In this ease, the pressing-tool body 43 may not have the protrusion 54 and/or the protrusion 55. Even if the pressing-tool body 43 does not have the protrusion 54 and/or the protrusion 55, the elastic member 40 can be secured stably to the pressing-tool body 43 when the elastic member 40 fits in the fitting groove(s) formed in the side surface 49 and/or the side surface 48.

As shown in FIG. 4, the movable shaft 15 is movable in the axial direction thereof in the housing 18. In this embodiment, the movable shaft 15 is constituted of a ball spline shaft. A ball spline nut 30 is disposed in the housing 18, so that the movable shaft 15 is supported movably in a vertical direction by the ball spline nut 30. In one embodiment, the movable shaft 15 may be movably supported on an inner surface of the housing 18.

The housing 18 includes a housing body 18A forming a space for housing the movable shaft 15 therein and a lid 18B configured to close the space. The lid 18B is detachably fixed to the housing body 18A by screws 31. The partition membrane 25 is in contact with the end portion (lower end) of the movable shaft 15, and an edge of the partition membrane 25 is sandwiched between the housing body 18A and the lid 18B. The partition membrane 25 is only in contact with the movable shaft 15 and is not fixed to the movable shaft 15.

The pressure chamber 20 is formed by the partition membrane 25 and the inner surface of the housing 18. More specifically, the pressure chamber 20 is formed by the partition membrane 25 and an inner surface of the lid 18B. A compressed-gas flow passage 33 communicating with the pressure chamber 20 is formed in the lid 18B of the housing 18. The compressed-gas flow passage 33 is coupled to a compressed-gas supply source 38 via a pressure regulator 36 and a switching valve 35. The switching valve 35 is a valve configured to selectively communicate the compressed-gas flow passage 33 with the compressed gas supply source 38 or the atmosphere. A three-way valve can be used as the switching valve 35. A pump, or a compressed-gas supply line as a utility equipment pre-installed in a factory can be used as the compressed-gas supply source 38.

The partition membrane 25 is made of a flexible material. Examples of the material constituting the partition membrane 25 include chloroprene rubber, fluoro-rubber, and silicone rubber. Chloroprene rubber having high bending fatigue resistance is preferably used.

Figure 6:
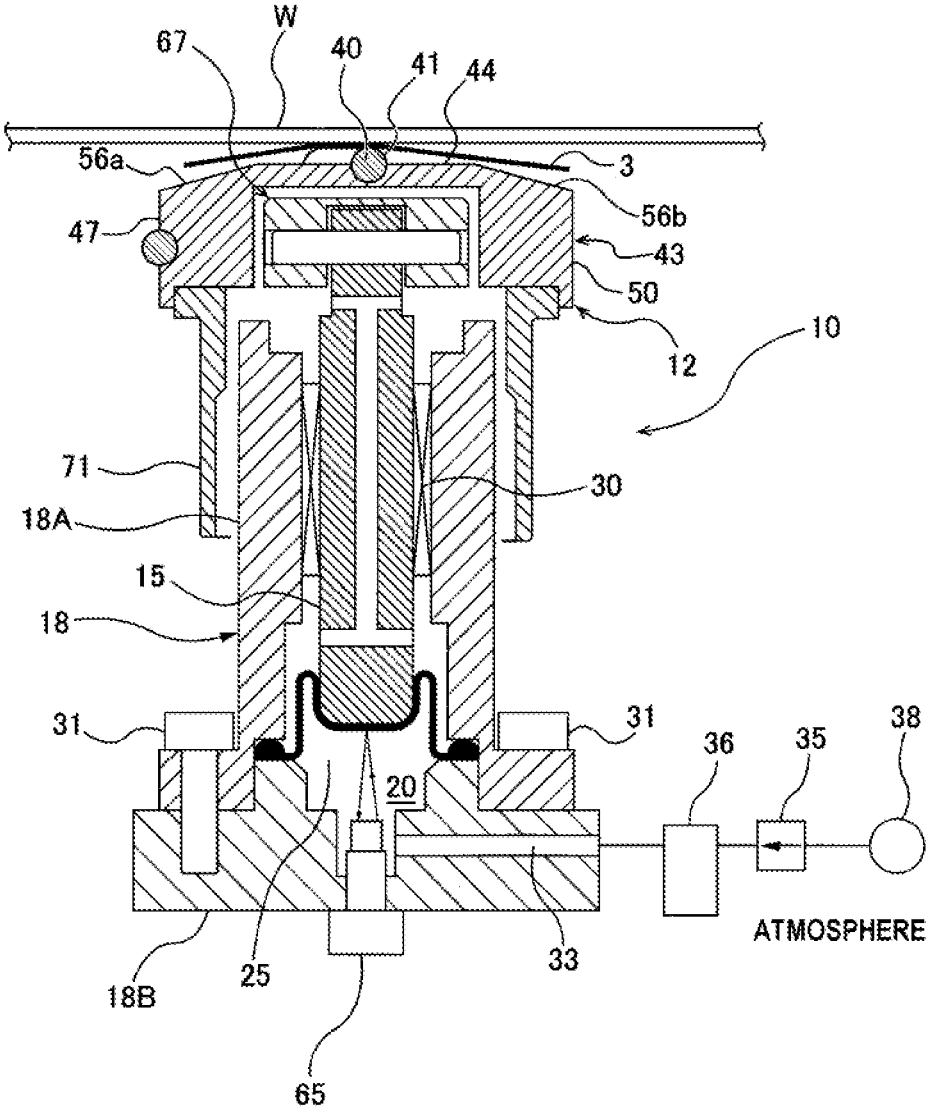
FIG. 6 is a diagram showing a movable shaft and a pressing tool when elevated.

When the wafer W is to be polished, the switching valve 35 is operated to allow the compressed-gas flow passage 33 to communicate with the compressed-gas supply source 38. Compressed gas, such as compressed air, is supplied from the compressed-gas supply source 38 through the compressed-gas flow passage 33 into the pressure chamber 20. A pressure of the compressed gas in the pressure chamber 20 is controlled by the pressure regulator 36. The pressure of the compressed gas in the pressure chamber 20 acts on the end portion (lower end) of the movable shaft 15 through the partition membrane 25, and elevates the movable shaft 15 and the pressing tool 12. FIG. 6 is a diagram showing the movable shaft 15 and the pressing tool 12 when elevated. The elastic member 40 of the pressing tool 12 can press the polishing tape 3 against the lower surface of the wafer W.

As shown in FIG. 6, when the elastic member 40 presses the polishing tape 3 against the lower surface of the wafer W, the polishing tape 3 bends in a direction toward the pressing-tool body 43. Thus, in order to prevent the polishing tape 3 from coming into contact with the pressing-tool body 43, the pressing-tool body 43 of the present embodiment further has a plurality of tapered surfaces 56*a* and 56*b* extending obliquely from the pressing surface 44. More specifically, the tapered surface 56*a* extends obliquely downward from the pressing surface 44 and is coupled to the side surface 47. The other tapered surface 56*b* extends obliquely downward from the pressing surface 44 and is coupled to a side surface 50 which is an opposite side from the side surface 47. These tapered surfaces 56*a* and 56*b* can prevent the polishing tape 3 from contacting the pressing-tool body 43 when the elastic member 40 presses the polishing tape 3 against the lower surface of the wafer W.

When the polishing of the wafer W is to be terminated, the switching valve 35 is operated to allow the compressed-gas flow passage 33 to communicate with the atmosphere. The pressure chamber 20 is ventilated to the atmosphere, and as a result, the movable shaft 15 and the pressing tool 12 are lowered to a retracted position shown in FIG. 4 due to weight of the movable shaft 15 and tension of the polishing tape 3.

At least a part of a distance sensor 65 configured to measure a movement distance of the movable shaft 15 relative to the housing 18 is disposed in the pressure chamber 20. The entire distance sensor 65 may be disposed in the pressure chamber 20. The distance sensor 65 of the present embodiment is a non-contact optical distance sensor. A distal end of the distance sensor 65 is oriented toward the end portion of the movable shaft 15.

As shown in FIG. 6, the pressing tool 12 is coupled to an upper end of the movable shaft 15 via a universal joint 67. The universal joint 67 is disposed between the movable shaft 15 and the pressing tool 12, and is housed inside the pressing tool 12. Such an arrangement can reduce moment caused by a reaction force applied from the wafer W to the pressing tool 12 when the polishing tape 3 is in contact with the wafer W. As a result, a posture of the polishing head 10 can be stable.

The universal joint 67 allows the pressing tool 12 to tilt in all directions with respect to the movable shaft 15. Therefore, when the pressing tool 12 presses the polishing tape 3 against the surface of the wafer W, the pressing tool 12 automatically becomes parallel to the surface of the wafer W. The universal joint 67 configured to tiltably support the pressing tool 12 allows the polishing tape 3 to be pressed uniformly against the surface of the wafer W.

As shown in FIG. 4, a skirt 71 is fixed to the pressing tool 12. The skirt 71 extends downward from the pressing tool 12 and surrounds an upper portion of the housing 18. In the present embodiment, the skirt 71 has a cylindrical shape, but the skirt 71 may have another shape as long as it can surround the upper portion of the housing 18. The skirt 71 can prevent liquid, such as pure water, used far the polishing of the wafer W from entering the universal joint 67 and the housing 18.

Since the polishing head 10 having the above-described configuration is compact as a whole, the polishing head 10 can be arranged below the wafer W. Further, a plurality of polishing heads 10 can be arranged below the wafer W.

Figure 7:
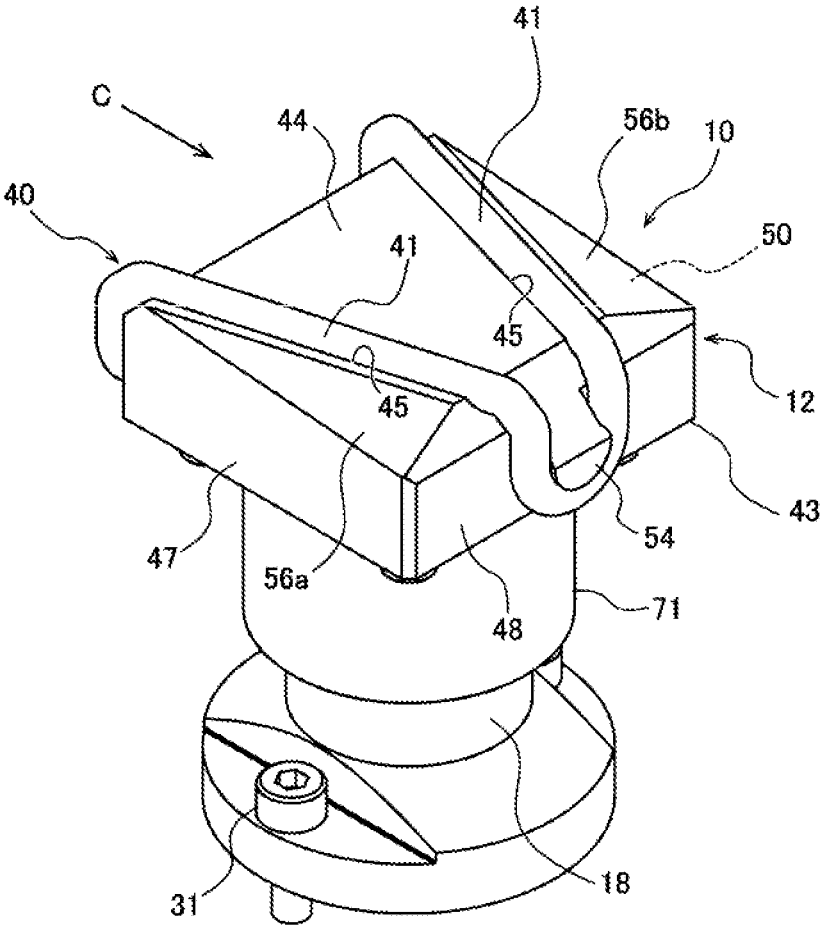
FIG. 7 is a perspective view showing another embodiment of the polishing head.
Figure 8:
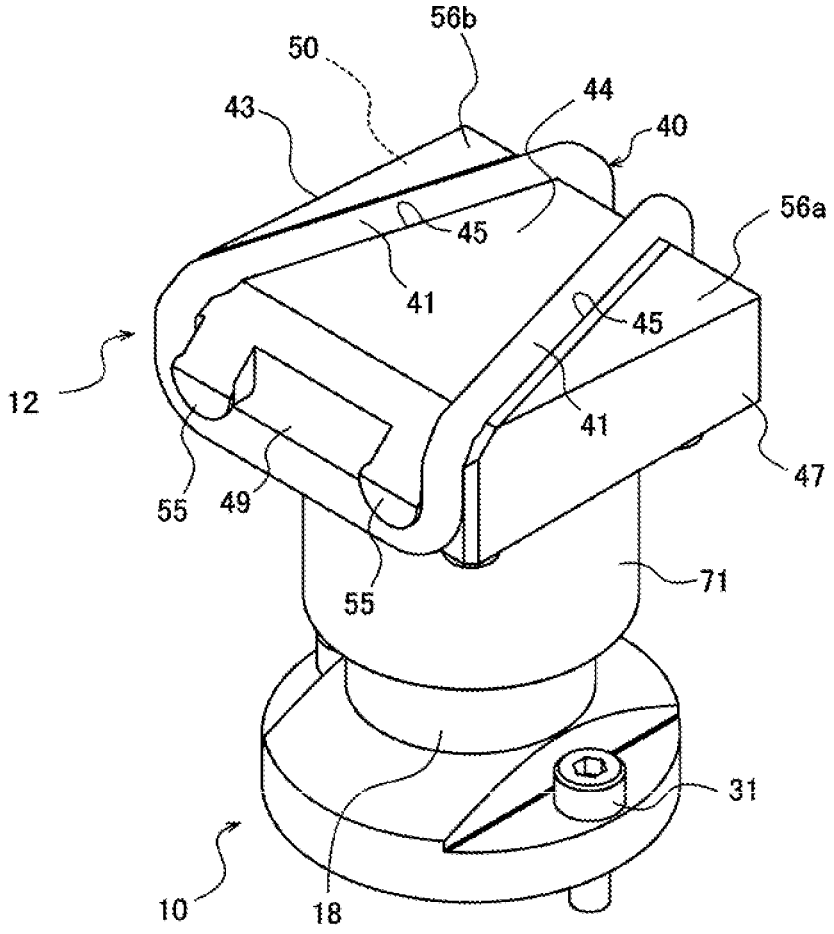
FIG. 8 is a diagram showing the polishing head shown in FIG. 7 as viewed from a direction indicated by an arrow C in FIG. 7.
Figure 9:
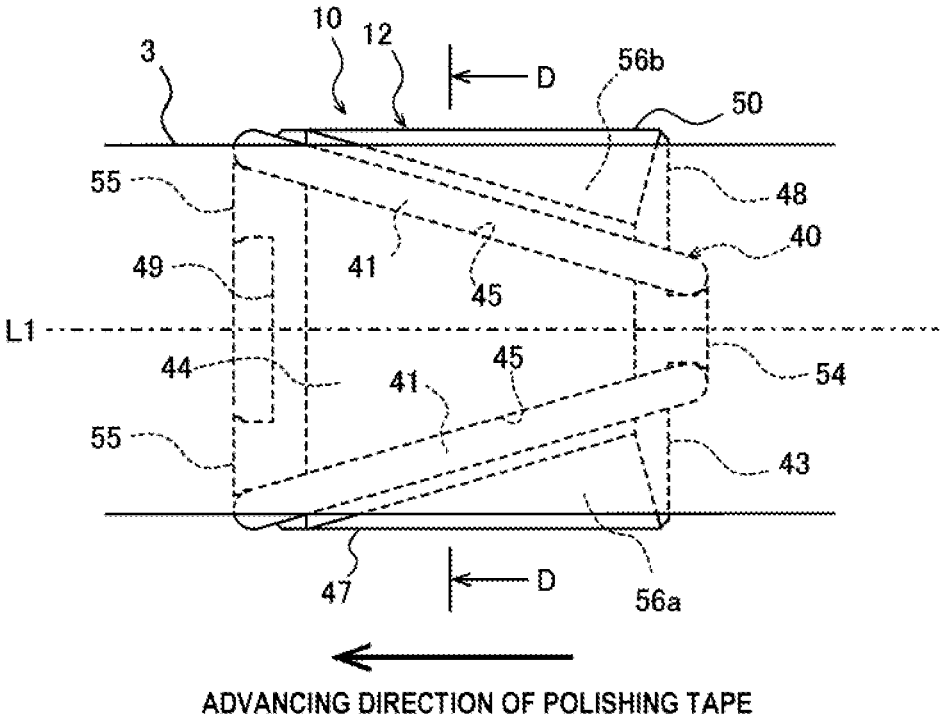
FIG. 9 is a plan view of the polishing head shown in FIG. 7.
Figure 10:
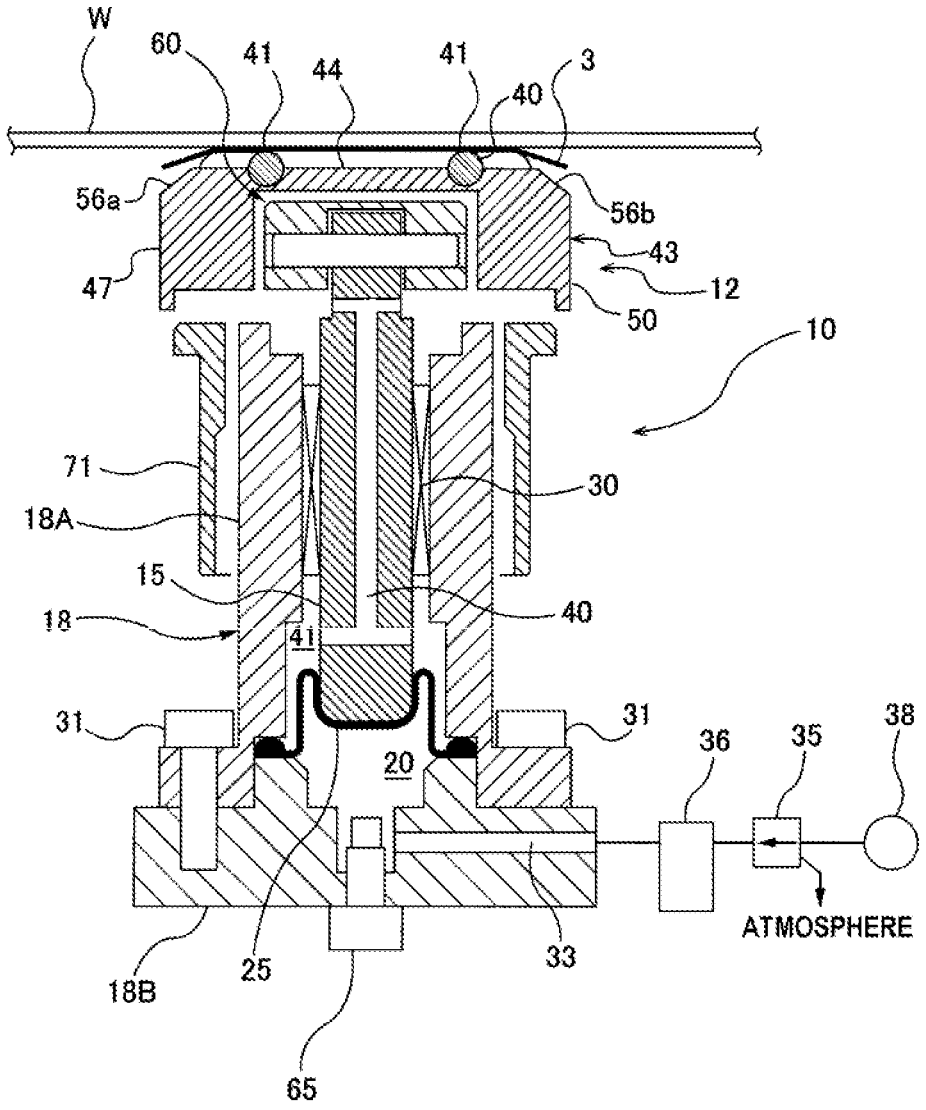
FIG. 10 is a cross-sectional view taken along a line D-D in FIG. 9.
Figure 11:
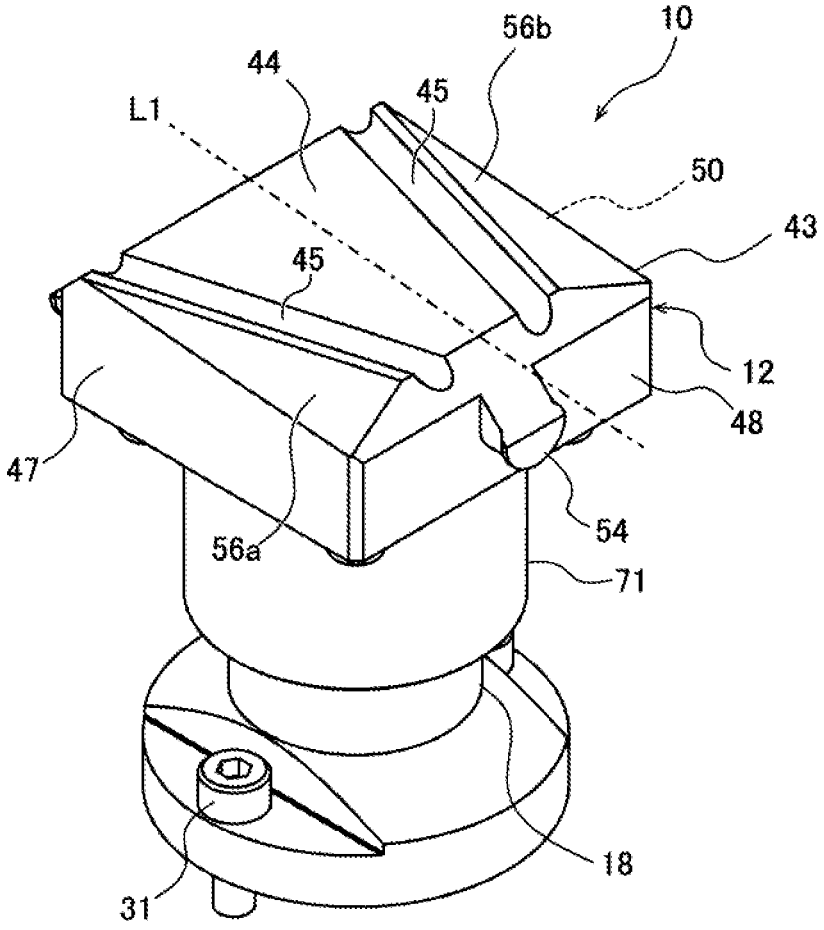
FIG. 11 is a diagram showing the pressing-tool body of FIG. 7 from which the elastic member has been removed.

FIG. 7 is a perspective view showing another embodiment of the polishing head 10. FIG. 8 is a diagram showing the polishing head 10 shown in FIG. 7 as viewed from a direction indicated by an arrow C in FIG. 7. FIG. 9 is a plan view of the polishing head 10 shown in FIG. 7. FIG. 10 is a cross-sectional view taken along a line D-D in FIG. 9. FIG. 11 is a diagram showing the pressing-tool body 43 shown in FIG. 7 from which the elastic member 40 has been removed. FIG. 10 shows the elastic member 40 when pressing the polishing tape 3 against the lower surface of the wafer W. Details of the present embodiment, which will not be particularly described, are the same as those of the embodiments described with reference to FIGS. 1 to 6, and duplicated descriptions will be omitted.

The pressing-tool body 43 the present embodiment has a plurality of fitting grooves 45 in the pressing surface 44. Specifically, the pressing-tool body 43 has two fitting wows 45 in the pressing surface 44. The two fitting grooves 45 are located away from each other, and are inclined obliquely with respect to the advancing direction of the polishing tape 3 when the pressing-tool body 43 is viewed from above. In this embodiment, the two fitting grooves 45 are arranged symmetrically about a center line L1 (see FIG. 9) of the pressing surface 44 located between the side surface 47 and the side surface 50. In one embodiment, the two fitting grooves 45 may be not arranged symmetrically about the center line L1 as long as the fitting grooves 45 are inclined obliquely with respect to the advancing direction of the polishing tape 3. The pressing-tool body 43 includes a protrusion 54 fixed to the side surface 48 of the pressing-tool body 43, and a plurality of protrusions 55 fixed to the side surface 49. When the pressing-tool body 43 is viewed from above, the protrusion 54 is arranged on the center line L1. The two protrusions 55 are located away from each other and are arranged at the same height. When the pressing-tool body 43 is viewed from above, the two protrusions 55 are arranged symmetrically about the center line L1. The elastic member 40 is put on the protrusion 54 and the protrusions 55 with the elastic member 40 elastically deformed, while the elastic member 40 fits in the two fitting grooves 45. With the above-described arrangement of the protrusion 54 and the protrusions 55, the elastic member 40 can be secured stably to the pressing-tool body 43. In one embodiment, the protrusion 54 may not be arranged on the center line L1, and the two protrusions 55 may not be arranged symmetrically about the center line L1, as long as the protrusion 54 and the protrusions 55 are arranged such that the elastic member 40 can be stably secured to the pressing-tool body 43.

The elastic member 40 has two portions 41 fitting in the two fitting grooves 45, respectively. These two portions 41 protrude from the pressing surface 44. The two portions 41 of the elastic member 40 can increase a contact area between the polishing tape 3 and the elastic member 40, and can increase a polishing, rate of the wafer W. According to the configuration of the present embodiment described above, the two portions 41 can be configured by the single elastic member 40. As a result, the polishing rate of the wafer W can be increased with a low-cost configuration.

In one embodiment, the number of protrusions 55 may not be two. For example, the pressing-tool body 43 may include a single laterally-elongated protrusion 55 or may include three or more protrusions 55. Further, in one embodiment, the plurality of protrusions 55 may not be arranged at the same height as long as the elastic member 40 can be stably secured to the pressing-tool body 43.

Figure 12:
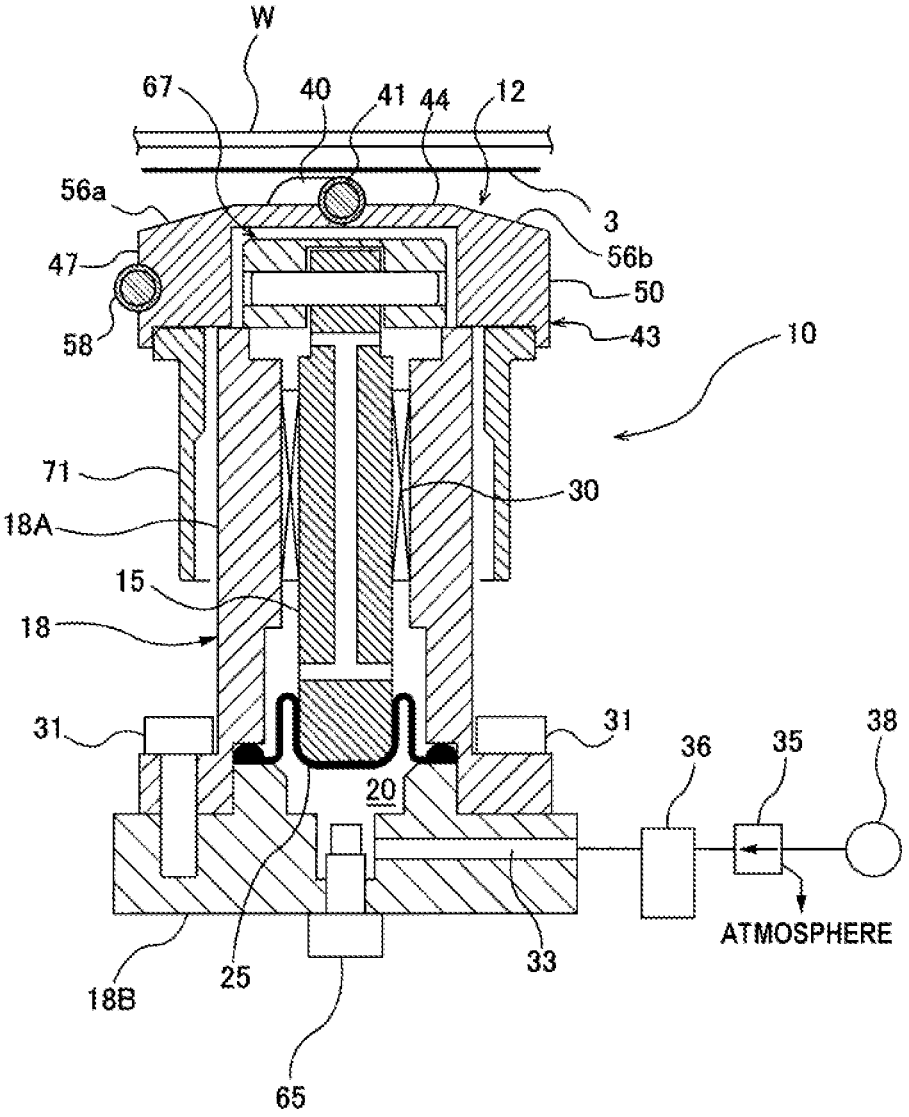
FIG. 12 is a cross-sectional view showing still another embodiment of the polishing head.

FIG. 12 is a cross-sectional view showing still another embodiment of the polishing head 10. Details of the present embodiment, which will not be particularly described, are the same as those of the embodiments described with reference to FIGS. 1 to 6, and duplicated descriptions will be omitted. The elastic member 40 of the present embodiment is covered with a coating layer 58 containing a fluororesin. The coating layer 58 covering the elastic member 40 can reduce a sliding resistance between the elastic member 40 and the back surface of the polishing tape 3 during the polishing of the wafer W. As a result, during the polishing of the wafer W, the polishing tape 3 can be advanced smoothly, and a force required to advance the polishing tape 3 can be reduced. The polishing head 10 of the present embodiment can also be applied to the embodiments described with reference to FIGS. 7 to 11.

Figure 13:
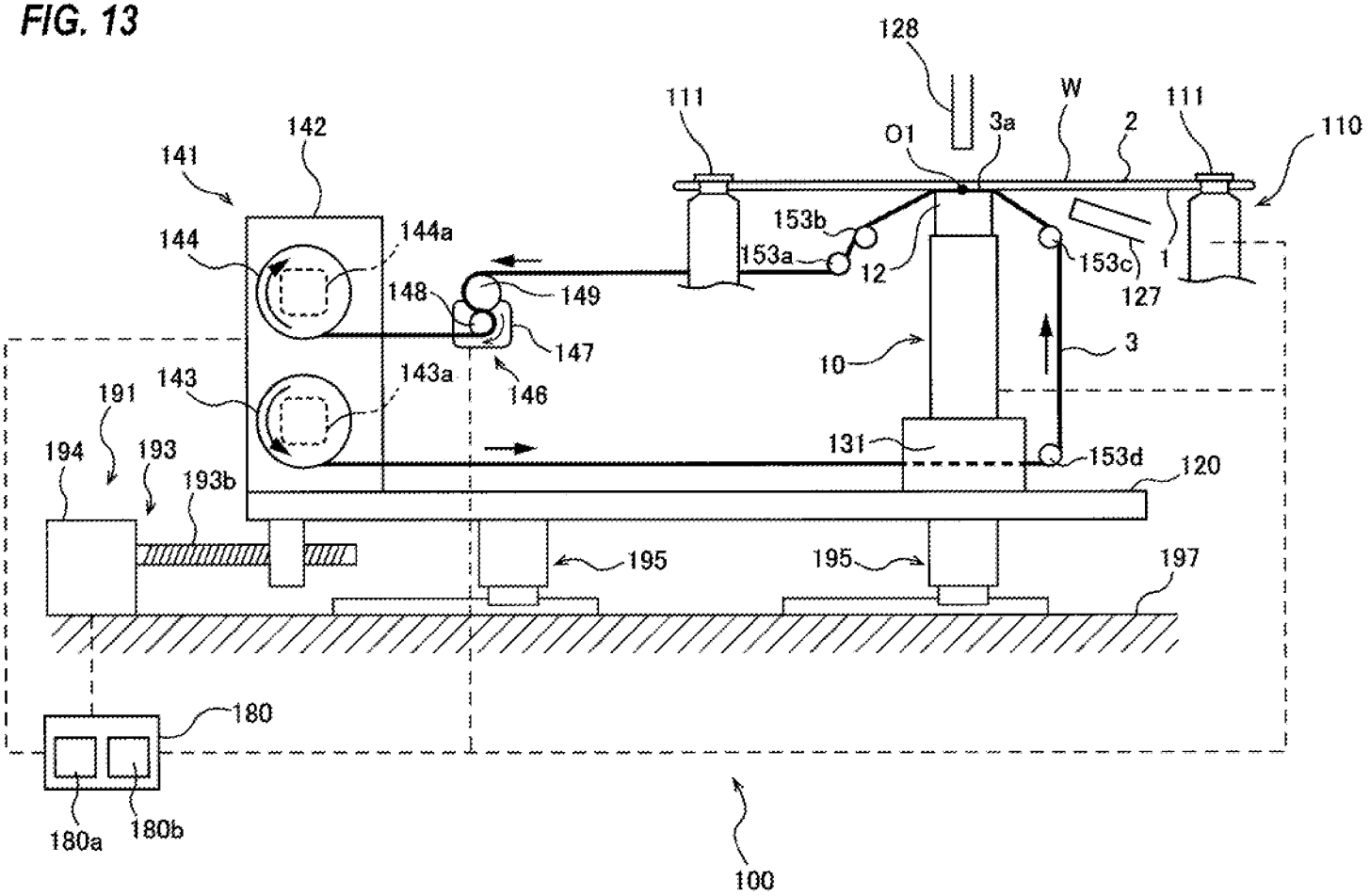
FIG. 13 is a diagram showing an embodiment of a polishing apparatus including the polishing head.

FIG. 13 is a diagram showing an embodiment of a polishing apparatus including the polishing head 10. A polishing apparatus 100 shown in FIG. 13 includes a substrate holder 110 configured to hold a wafer W, which is an example of a substrate, and rotate the wafer W about its own axis, the above-described polishing head 10 configured to bring a polishing tape 3 as a polishing tool into contact with a first surface 1 of the wafer W held by the substrate holder 110 to polish the first surface 1 of the wafer W, and a polishing-tape supply mechanism 141 configured to supply the polishing tape 3 to the polishing head 10.

The substrate holder 110 includes a plurality of rollers 111 which can contact a periphery of the wafer W, and a roller-rotating mechanism (not shown) configured to rotate the plurality of rollers 111 about their respective own axes. The polishing head 10 is arranged below the wafer W held by the substrate holder 110. A part of the substrate holder 110 is not shown in FIG. 13. The substrate holder 110 of the present embodiment includes four rollers 111 (two of which are not shown).

In the present embodiment, the first surface 1 of the wafer W is a back surface of the wafer W on which no device is formed or no device is to be formed, i.e., a non-device surface. A second surface 2 of the wafer W opposite to the first surface 1 is a surface on which devices are formed or devices are to be formed, i.e., a device surface. In this embodiment, the wafer W is held by the substrate holder 110 horizontally with the first surface 1 facing downward.

The roller-rotating mechanism is configured to rotate the four rollers 111 with the same speed in the same direction. During polishing of the first surface 1 of the wafer W, the periphery of the wafer W is held by the rollers 111. The wafer W is held horizontally, and is rotated about its own axis by the rotations of the rollers 111. During the polishing of the first surface 1 of the wafer W, the four rollers 111 rotate about their respective own axes, but the positions of the rollers 111 themselves are stationary.

As shown in FIG. 13, a rinsing-liquid supply nozzle 127 configured to supply a rinsing liquid (e.g., pure water or an alkaline chemical solution) to the first surface 1 of the wafer W is disposed below the wafer W held by the substrate holder 110. The rinsing-liquid supply nozzle 127 is coupled to a not-shown rinsing-liquid supply source. The rinsing-liquid supply nozzle 127 is oriented toward the center O1 of the first surface 1 of the wafer W. The rinsing liquid is supplied from the rinsing-liquid supply nozzle 127 to the first surface 1 of the wafer W, and spreads over the first surface 1 of the wafer W due to centrifugal force. The rinsing liquid flows on the first surface 1 of the wafer W outward in a radial direction, whereby polishing debris can be removed from the first surface 1 of the wafer W.

A protecting-liquid supply nozzle 128 configured to supply a protecting liquid (e.g., pure water) onto the second surface 2 of the wafer W is disposed above the wafer W held by the substrate holder 110. The protecting-liquid supply nozzle 128 is coupled to a not-shown protecting-liquid supply source. The protecting-liquid supply nozzle 128 is oriented toward the center of the second surface 2 of the wafer W. The protecting liquid is supplied from the protecting-liquid supply nozzle 128 to the center of the second surface 2 of the wafer W, and spreads over the second surface 2 of the wafer W due to the centrifugal force. The protecting liquid prevents the rinsing liquid containing the polishing debris and foreign matter generated by the polishing of the wafer W from contacting the second surface 2 of the wafer W and adhering to the second surface of the wafer W. As a result, the second surface 2 of the Wafer W can be kept clean.

The polishing head 10 is supported by a support member 131, and the support member 131 is fixed to a movable plate 120. Therefore, the entire polishing head 10 can be moved together with the movable plate 120. The support member 131 has a not-shown through-hole, and the polishing tape 3 extends through the through-hole.

The polishing-tape supply mechanism 141 includes a tape feeding reel 143 configured to supply the polishing tape 3 and a tape take-up reel 144 configured to collect the polishing tape 3. The tape feeding reel 143 and the tape take-up reel 111 are coupled to tension motors 143*a* and 144*a*, respectively. These tension motors 143*a* and 144*a* are fixed to a reel base 142 and ore configured to apply predetermined torques to the tape feeding reel 143 and the tape take-up reel 144 to thereby apply a predetermined tension to the polishing tape 3. The reel base 142 is fixed to the movable plate 120, so that the entire polishing-tape supply mechanism 141 can move together with the movable plate 120.

A tape advancing device 146 configured to advance the polishing tape 3 in a longitudinal direction thereof is provided between the tape feeding reel 143 and the tape take-up reel 144. The tape advancing device 146 includes a tape advancing roller 148 configured to advance the polishing tape 3, a nip roller 149 configured to press the polishing tape 3 against the tape advancing roller 148, and a tape advancing motor 147 configured to rotate the tape advancing roller 148. The polishing tape 3 is sandwiched between the nip roller 149 and the tape advancing roller 148. When the tape advancing motor 147 rotates the tape advancing roller 148 in a direction indicated by an arrow in FIG. 13, the polishing tape 3 is advanced or fed from the tape feeding reel 143 to the tape take-up reel 144 via the pressing tool 12 of the polishing head 10. An advancing speed of the polishing tape 3 can be changed by changing a rotation speed of the tape advancing motor 147. In one embodiment, the direction in which the polishing tape 3 is advanced may be opposite to the direction indicated by arrows in FIG. 13 (an arrangement of the tape feeding reel 143 and the tape take-up reel 144 may be interchanged). Also in, this case, the tape advancing device 146 is disposed at the tape take-up reel 144 side. The polishing tape 3 is supplied to the pressing tool 12 such that a polishing surface 3*a* of the polishing tape 3 faces the first surface 1 of the wafer W.

The polishing apparatus 100 further includes plurality of guide rollers 153*a*, 153*b*, 153*c*, and 153*d* configured to support the polishing tape 3. The polishing tape 3 is guided so as to surround the polishing head 10 by these guide rollers 153*a*, 153*b*, 153*c*, and 153*d*. The polishing head 10 polishes the first surface 1 of the wafer W by pressing the polishing tape 3 from the back side thereof against the first surface 1 of the wafer W with the pressing tool 12. The guide rollers 153*b* and 153*c* arranged at an upper portion of the polishing head 10 guide the polishing tape 3 such that the polishing tape 3 advances in a direction parallel to the first surface 1 of the wafer W.

The tape advancing device 146 and the guide rollers 153*a*, 153*b*, 153*c*, and 153*d* are fixed to a not-shown holding member, which is fixed to the movable plate 120.

In order to bring the polishing tape 3 into contact with a region ranging from the center O1 to an outermost portion of the first surface 1 of the wafer W, the polishing apparatus 100 of the present embodiment includes a polishing-head moving mechanism 191 configured to translate the polishing head 10 relative to the substrate holder 110. The polishing-head moving mechanism 191 is configured to move the polishing head 10 between the center O1 of the first surface 1 of the wafer W and the outermost portion of the first surface 1.

A plurality of linear-motion guides 195 are fixed to a lower surface of the movable plate 120, and the movable plate 120 is supported by the plurality of linear-motion guides 195. The plurality of linear-motion guides 195 are disposed on a mounting surface 197. The movable plate 120 is moved by the polishing-head moving mechanism 191 and the linear-motion guide 195 restricts the movement of the movable plate 120 to a linear motion in the radial direction of the wafer W.

The polishing-head moving mechanism 191 includes a ball-screw mechanism 193 and a motor 194 configured to drive the ball-screw mechanism 193. A servo motor can be used as the motor 194. The movable plate 120 is coupled to a screw shaft 193*b* of the ball-screw mechanism 193. When the polishing-head moving mechanism 191 operates, the polishing head 10, the polishing-tape supply mechanism 141, the tape advancing device 146, and the guide rollers 153*a*, 153*b*, 153*c*, and 153*d* are moved in the radial direction of the wafer W relative to the substrate holder 110.

During the polishing of the water W, the polishing-head moving mechanism 191 moves the polishing head 10 between the center O1 of the first surface 1 of the wafer W and the outermost portion of the first surface 1. The polishing apparatus 100 further includes an operation controller 180 configured to control operations of each component of the polishing apparatus 100. The polishing-head moving mechanism 191 is electrically coupled to the operation controller 180, so that operations of the polishing-head moving mechanism 191 are controlled by the operation controller 180. When the polishing-head moving mechanism 191 operates, the polishing head 10, the polishing-tape supply mechanism 141, the tape advancing device 146, and the guide rollers 153*a*, 153*b*, 153*c*, and 153*d* are moved together.

During the polishing of the wafer W, the wafer W is rotated by the rollers 111. All the rollers ill rotate about their own axes, but the positions of these rollers 111 are fixed. Therefore, even if the polishing head 10 is moved from the center side of the wafer W to the outer side of the wafer W by the polishing-head moving mechanism 191, the rollers 111 do not contact the polishing head 10. As a result, the polishing tape 3 can polish the entire first surface 1 including the outermost portion of the wafer W.

Figure 14:
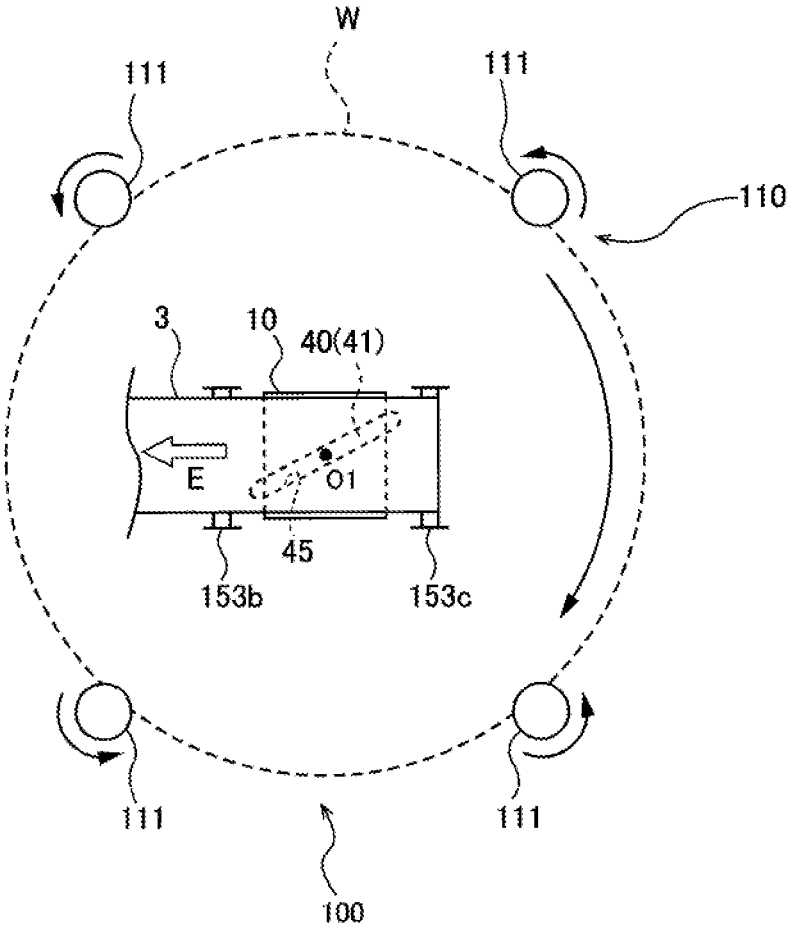
FIG. 14 is a plan view showing an arrangement of the polishing head.

FIG. 14 is a plan view showing an arrangement of the polishing head 10. As shown in FIG. 14, the portion 41 of the elastic member 40 fitting in the fitting groove 45 is shorter than a radius of the wafer W. The portion 41 of the elastic member 40 and the fitting groove 45 extend obliquely with respect to the advancing direction (indicated by an arrow E) of the polishing tape 3. In this embodiment, the advancing direction E of the polishing tape 3 coincides with the longitudinal direction of the polishing tape 3. Since the portion 41 of the elastic member 40 fitting in the fitting groove 45 is inclined obliquely with respect to the advancing direction E of the polishing tape 3 (i.e., the longitudinal direction of the polishing tape 3), an unused polishing tape 3 can be brought into contact with the wafer W even at the downstream side (in the case of this embodiment, an outer peripheral side of the wafer W) of the advancing direction F of the polishing, tape 3. As a result, the polishing rate can be prevented from decreasing due to the use of the polishing tape 3 deteriorated by the polishing. In one embodiment, the portion 41 of the elastic member 40 fitting in the fitting groove 45 may be longer than the radius of the wafer W. Further, in one embodiment, the portion 41 of the elastic member 40 fitting in the fitting groove 45 may be perpendicular to the advancing direction E of the polishing tape 3.

The operations of the polishing apparatus 100 of this embodiment will now be described. The operations of the polishing apparatus 100 described below are controlled by the operation controller 180 shown in FIG. 13. The operation controller 180 is electrically coupled to the substrate holder 110, the polishing head 10, the polishing-tape supply mechanism 141, the tape advancing device 146, and the polishing-head moving mechanism 191. The operations of the substrate holder 110, the rinsing-liquid supply nozzle 127, the protecting-liquid supply nozzle 128, the polishing head 10, the polishing-tape supply mechanism 141, the tape advancing device 146, and the polishing-head moving mechanism 191 are controlled by the operation controller 180.

The operation controller 180 is composed of at least one computer. The operation controller 180 includes a memory 180*a* and an arithmetic device 180*b*. The arithmetic device 180*b* includes a CPU (central processing unit), a GPU (graphic processing unit), etc. configured to perform arithmetic operations according to instructions contained in programs stored in the memory 180*a*. The memory 180*a* includes a main memory (e.g., a random-access memory) to which the arithmetic device 180*b* is accessible, and an auxiliary memory (e.g., a hard disk drive or a solid state drive) storing data and the programs therein.

The wafer W to be polished is held by the rollers 111 of the substrate holder 110 with the first surface 1 facing downward, and is further rotated about the axis of the wafer W. Specifically, the substrate holder 110 rotates the wafer W by rotating the plurality of rollers 111 about their own axes while the plurality of rollers 111 are in contact with the periphery of the wafer W with the first surface 1 of the wafer W facing downward. Next, the rinsing liquid is supplied from the rinsing-liquid supply nozzle 127 to the first surface 1 of the wafer W, and the protecting liquid is supplied from the protecting-liquid supply nozzle 128 onto the second surface 2 of the wafer W. The rinsing liquid flows radially outward on the first surface 1 of the wafer W, and the protective liquid spreads over the entire second surface 2 of the wafer W due to the centrifugal force.

The polishing-head moving mechanism 191 moves the polishing head 10 to a position below the center O1 of the first surface 1 of the wafer W. The operation controller 180 operates the polishing-tape supply mechanism 111 and the tape advancing device 146 to advance the polishing tape 3 in the longitudinal direction thereof with a predetermined speed while the predetermined tension is applied to the polishing tape 3. Next, the polishing head 10 brings the polishing surface 3*a*, of the polishing tape 3 into contact with the first surface 1 of the wafer W to start the polishing of the first surface 1 of the wafer W in the presence of the rinsing liquid. Further, the polishing-head moving mechanism 191 moves the polishing head 10, the polishing-tape supply mechanism 141, the guide rollers 153*a*, 153*b*, 153*c*, and 153*d*, and the tape advancing device 146 outward in the radial direction of the wafer W, while the polishing head 10 presses the first surface 1 of the wafer W with the polishing tape 3. During the polishing of the wafer W, the rinsing-liquid supply nozzle 127 and the protecting-liquid supply nozzle 128 continuously supply the rinsing liquid and the protecting liquid to the wafer W.

When the polishing head 10 reaches the outermost portion of the first surface 1 of the wafer W, the operation controller 180 terminates the polishing of the wafer W. Specifically, the polishing head 10 lowers the pressing tool 12 to separate the polishing tape 3 from the first surface 1 of the wafer W. Thereafter, the operation controller 180 stops the operations of the substrate holder 110, the rinsing-liquid supply nozzle 127, the protecting-liquid supply nozzle 128, the polishing-tape supply mechanism 141, and the tape advancing device 146 to terminate the polishing the wafer W. In one embodiment, the polishing-head moving mechanism 191 may reciprocate the polishing head 10 between the outermost portion and the center O1 of the first surface 1 of the wafer W.

Figure 15:
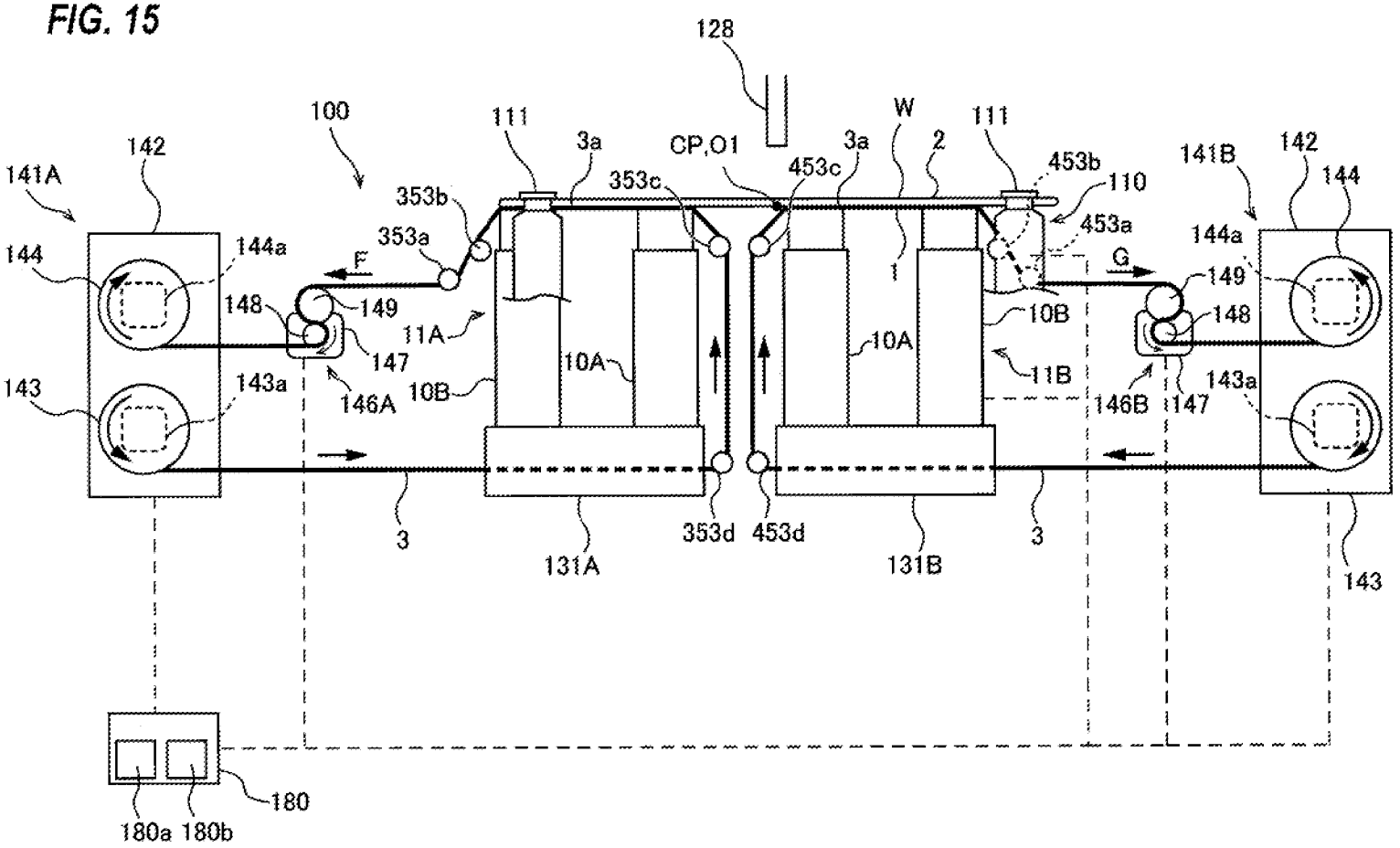
FIG. 15 is a diagram showing another embodiment of the polishing apparatus.
Figure 16:
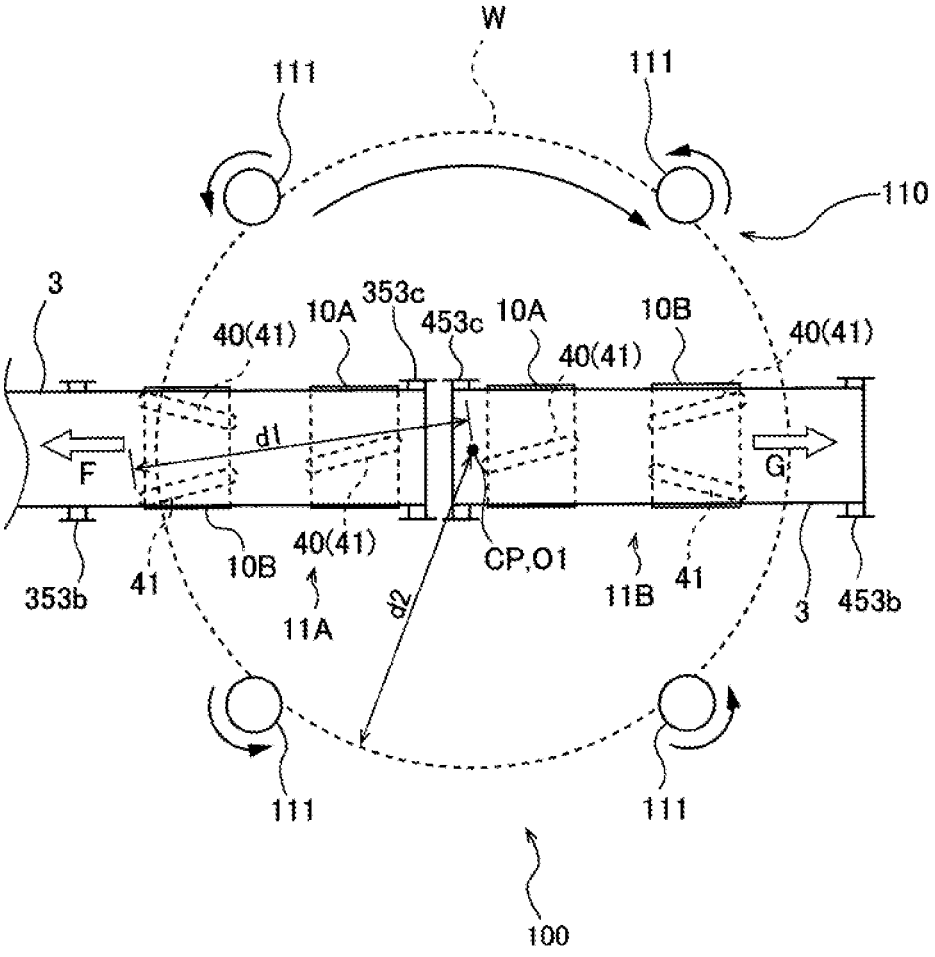
FIG. 16 is a plan view of the polishing apparatus shown in FIG. 15.

FIG. 15 is a diagram showing another embodiment of the polishing apparatus 100. FIG. 16 is a top view of the polishing apparatus 100 shown in FIG. 15. Details of the present embodiment, which will not be particularly described, are the same as those of the embodiments described with reference to FIGS. 13 and 14, and duplicated descriptions will be omitted. The rinsing-liquid supply nozzle 127 is not shown in FIG. 15. The polishing apparatus 100 of the present embodiment includes polishing-head assemblies 11A and 11B, polishing-tape supply mechanisms 141A and 141B configured to supply polishing tapes 3 to the polishing head assemblies 11A and 11B, respectively, and tape advancing devices 146A and 146B configured to advance the polishing tapes 3 in the longitudinal direction thereof. The polishing head assembly 11A includes polishing heads 10A and 10B. Similarly, the polishing head assembly 11B includes polishing heads 10A and 10B. The polishing head assembly 11A is supported by a support member 131A, and the polishing head assembly 11B is supported by a support member 131B. The polishing tape 3 supplied to the polishing head assembly 11A is supported by guide rollers 353*a*, 353*b*, 353*c*, and 353*d*, and the polishing tape 3 supplied to the polishing head assembly 11B is supported by guide rollers 453*a*, 453*b*, 453*c*, and 453*d*. The polishing head 10A corresponds to the polishing head 10 described with reference to FIGS. 1 to 6, and the polishing head 10B corresponds to the polishing head 10 described with reference to FIGS. 7 to 11. Configurations of the polishing-tape supply mechanisms 141A and 141B, the tape advancing devices 146A and 146B, the support members 131A and 131B, the guide rollers 353*a*, 353*b*, 353*c*, and 353*d*, and the guide roller 453*a*, 453*b*, 453*c*, and 453*d* are the same as the configurations of the polishing-tape supply mechanism 141, the tape advancing device 146, the support member 131, and the guide rollers 153*a*, 153*b*, 153*c*, and 153*d* described with reference to FIG. 13. The polishing apparatus 100 of the present embodiment does not include the polishing-head moving mechanism 191. Therefore, during the polishing, positions of the polishing head assemblies 11A and 11B are fixed. The coating layer 58 described with reference to FIG. 12 can be applied to the polishing heads 10A and 10B of the present embodiment.

The plurality of polishing heads 10A and 10B are arranged at different distances from an axis CP of the substrate holder 110 (or the center O1 of the first surface 1 of the wafer W). A distance d1 from the axis CP of the substrate holder 110 to an outermost end of the entire plurality of portions 41 is longer than a radius d2 of the wafer W.

During the polishing, the tape advancing device 146A advances the polishing tape 3 in a direction indicated by an arrow F in FIGS. 15 and 16, and the tape advancing device 146B advances the polishing tape 3 in a direction indicated by an arrow G in FIGS. 15 and 16. Specifically, each polishing tape 3 is advanced from a central portion toward an outer peripheral portion of the wafer W. As a result, the polishing debris generated by the polishing of the wafer W can be discharged efficiently from the center portion of the wafer W to the outside of the wafer W. The plurality of polishing heads 10A and 10B are configured to be operable independently of each other. The polishing heads 10A and 10B of the polishing head assembly 11A are arranged along the advancing direction F of the polishing tape 3 (i.e., the longitudinal direction of the polishing tape 3) with a gap therebetween. The polishing heads 10A and 10B of the polishing head assembly 11B are arranged along the advancing direction G of the polishing tape 3 (i.e., the longitudinal direction of the polishing tape 3) with a gap therebetween. Each of the plurality of portions 41 of the present embodiment extends obliquely with respect to the advancing directions F and G of the polishing tape 3. When viewed from the advancing direction F or the advancing direction G of the polishing tape 3, the plurality of portions 41 are continuously arranged along a direction perpendicular to the advancing directions F and G of the polishing tape 3. Further, when viewed from the advancing direction F or the advancing direction G of the polishing tape 3, the plurality of portions 41 are continuously arranged with no gap.

The plurality of portions 41 are not aligned in a straight line, but these portions 41 are located at different distances from the axial center CP of the substrate holder 110. Therefore, when the wafer W is rotating, each region of the first surface 1 of the wafer W passes through any of the plurality of portions 41. As a result, the plurality of elastic members 40 can press the polishing tape 3 against the entire surface of the first surface 1 of the wafer W.

Figure 17:
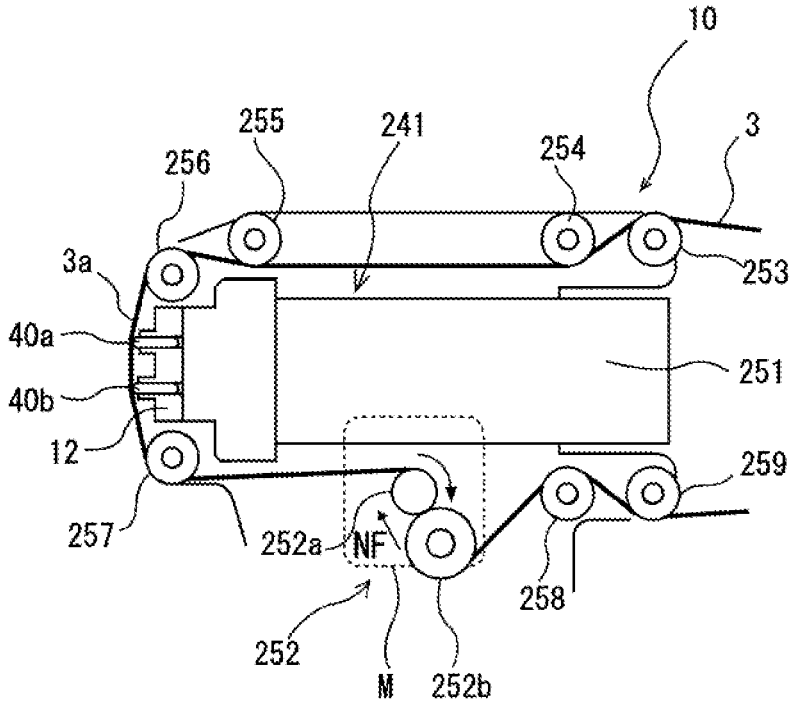
FIG. 17 is a diagram showing another embodiment of a polishing head.

FIG. 17 is a diagram showing another embodiment of the polishing head 10. The polishing head 10 of the present embodiment is also suitably used for a polishing apparatus that polishes a periphery of a substrate (e.g., a wafer). In the present specification, the periphery of the substrate is defined as a region including a bevel portion located at the outermost periphery of the substrate and a top-edge portion and a bottom-edge portion located radially inwardly of the bevel portion.

Figure 18A:
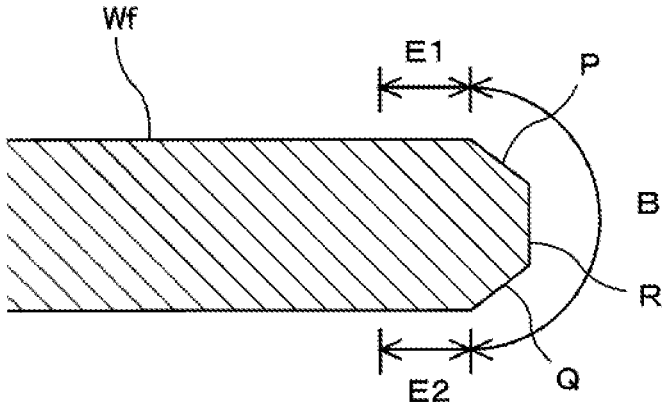
FIG. 18A is an enlarged cross-sectional view showing a periphery of a substrate.
Figure 18B:
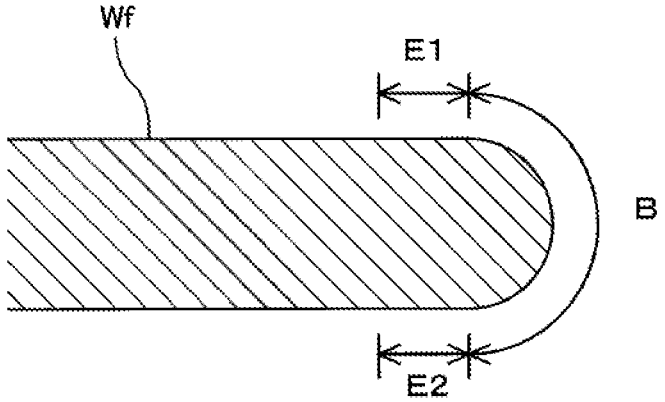
FIG. 18B is an enlarged cross-sectional view showing a periphery of a substrate.

FIGS. 18A and 18B are enlarged cross-sectional views showing the periphery of the substrate. More specifically, FIG. 18A is a cross-sectional view of a substrate of a so-called straight type, and FIG. 18B is a cross-sectional view of a substrate of a so-called round type. In the substrate Wf of FIG. 18A, the bevel portion is an outermost peripheral surface (indicated by symbol B) constituting an upper slope portion (or an upper bevel portion) P, a lower slope portion (or a lower bevel portion) Q, and a side portion (or an apex) R of the substrate Wf. In the substrate Wf of FIG. 18B, the bevel portion is a portion (indicated by symbol B) constituting an outermost peripheral surface of the substrate Wf and having a curved cross section. The top-edge portion is an annular flat portion E1 located radially inwardly of the bevel portion B, and located in a device surface of the substrate Wf. The bottom-edge portion is an annular flat portion E2 located at an opposite side from the top-edge portion and located radially inwardly of the bevel portion B. The top-edge portion E1 may include a region in which devices are formed.

Referring back to FIG. 17, the polishing head 10 includes a pressing mechanism 241 configured to press a polishing surface 3*a* of a polishing tape 3 against a wafer W with a predetermined force. Further, the polishing head 10 includes a tape advancing device 252 configured to advance the polishing tape 3 from a later-described tape feeding reel 243 (not shown in FIG. 17) to a later-described tape take-up reel 244 (not shown in FIG. 17). The polishing head 10 has a plurality of guide rollers 253, 254, 255, 256, 257, 258, and 259, and these guide rollers are arranged to guide the polishing tape 3 such that the polishing tape 3 advances in a direction perpendicular to a tangential direction of the wafer W.

The tape advancing device 252 provided on the polishing head 10 includes a tape advancing roller 252*a*, a tape holding roller 252*b*, and a motor M configured to rotate the tape advancing roller 252*a*. The motor M is mounted to a side surface of the polishing head 10, and the tape advancing roller 252*a* is attached to a rotating shaft of the motor M. The tape holding roller 252*b* is arranged adjacent to the tape advancing roller 252*a*. The tape holding roller 252*b* is supported by a not-shown mechanism that generate a force in a direction indicated by an arrow NF in FIG. 17 (direction toward the tape advancing roller 252*a*), so that the tape holding roller 252*b* presses the tape advancing roller 252*a*.

When the motor M rotates in a direction indicated by an arrow shown in FIG. 17, the tape advancing roller 252*a* rotates and can advance the polishing tape 3 from the tape feeding reel 243 (not shown in FIG. 17) via the polishing head 10 to the tape take-up reel 244 (not shown in FIG. 17). The tape holding roller 252*b* is configured to rotate about its own axis and rotates as the polishing tape 3 is advanced.

The pressing mechanism 241 includes a pressing tool 12 configured to press the polishing tape 3 against the wafer W, and an air cylinder (or driving mechanism) 251 configured to move the polishing tool 12 toward the periphery of the wafer W. The air cylinder 251 is a so-called single rod cylinder. By controlling an air pressure supplied to the air cylinder 251, a force for pressing the polishing tape 3 against the wafer W is regulated. The pressing tool 12 is disposed at a back side of the polishing tape 3.

Figure 19:
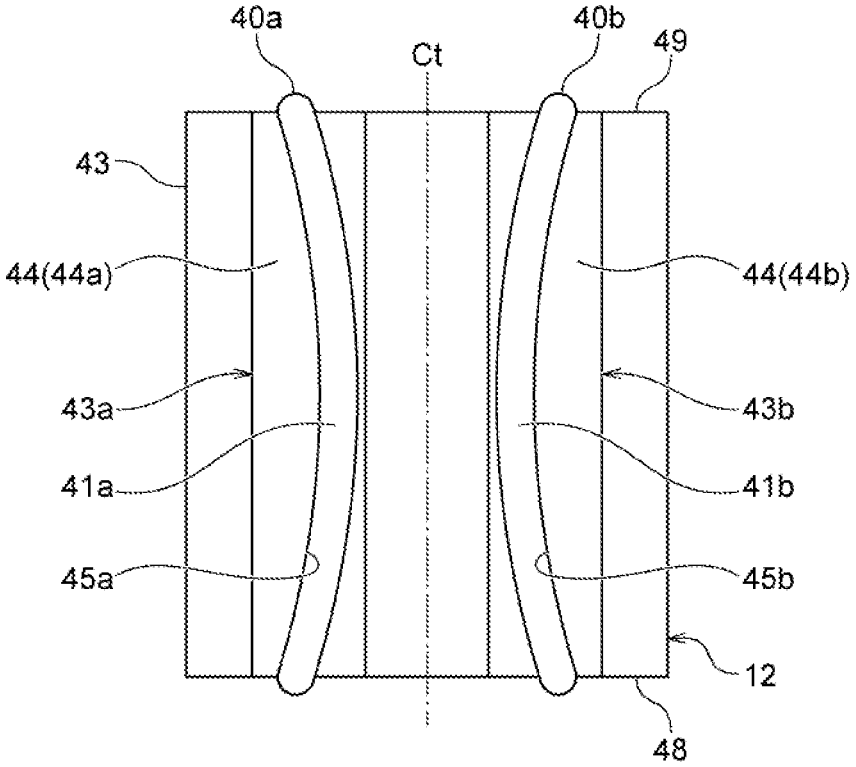
FIG. 19 is a diagram showing a pressing tool of the present embodiment as viewed from a front side (polishing-tape side)
Figure 20:
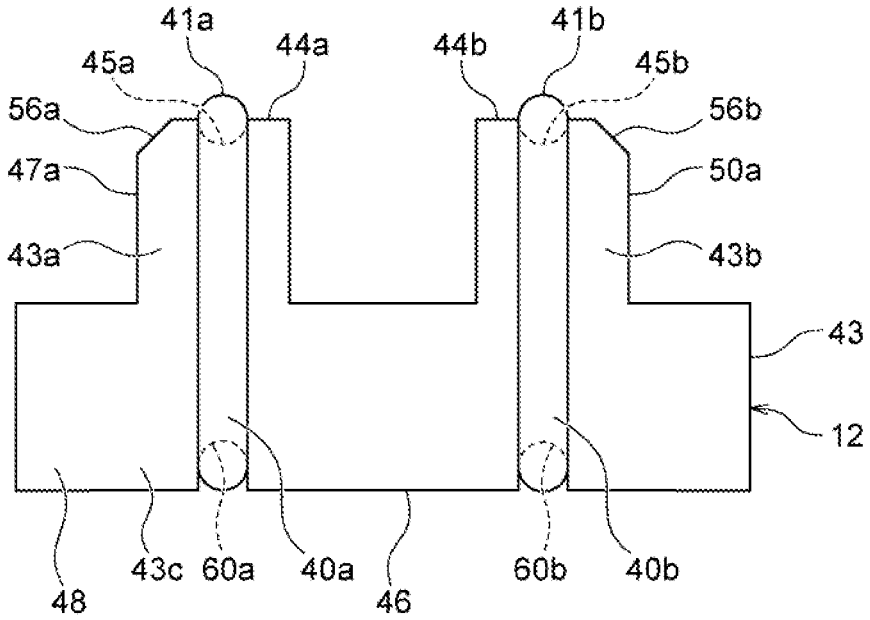
FIG. 20 is a side view of the pressing tool shown in FIG. 19.
Figure 21:
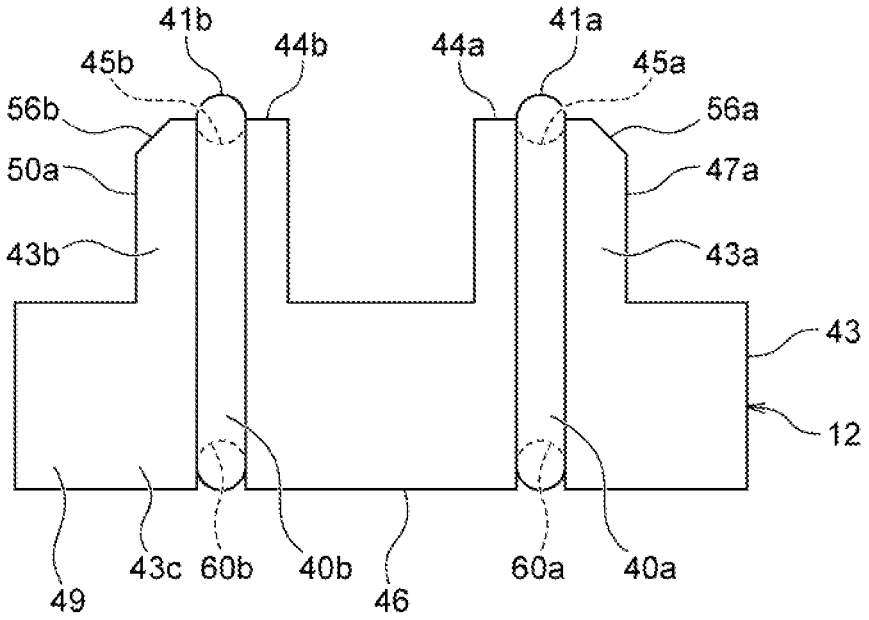
FIG. 21 is a side view of the pressing tool shown in FIG. 19.

FIG. 19 is a diagram of the pressing tool 12 of the present embodiment as viewed from a front side (polishing-tape side). FIG. 20 is a diagram of the pressing tool 12 shown in FIG. 19 as viewed from a side surface 48. FIG. 21 is a diagram of the pressing tool 12 shown in FIG. 19 as viewed from a side surface 49. Details of the pressing tool 12 of the present embodiment, which will not be particularly described, are the same as those of the embodiments described with reference to FIGS. 1 to 5, and duplicated descriptions will be omitted. As shown in FIG. 19, a pressing-tool body 43 of the pressing tool 12 of the present embodiment includes two raised portions 43*a* and 43*b* with a gap therebetween and a base portion 43*c* coupled to the raised portions 43*a* and 43*b*. The raised portion 43*a* and the raised portion 43*b* are arranged in parallel. The raised portions 43*a* and 43*b* and the base portion 43*c* may be formed integrally.

The raised portion 43*a* has a pressing surface 44*a*, and the raised portion 43*b* has a pressing surface 44*b*. In other words, the pressing surface 44 of the present embodiment is constituted of the pressing surface 44*a* and the pressing surface 44*b* arranged with a gap therebetween. The pressing surface 44*a* and the pressing surface 44*b* are arranged in parallel. The pressing surfaces 44*a* and 44*b* have fitting grooves 45*a* and 45*b*, respectively. When viewed from the front side of the pressing tool 12, the fitting grooves 45*a* and 45*b* are arranged symmetrically about a center line Ct and are curved inward toward the center line Ct. More specifically, the fitting grooves 45*a* and 45*b* have an arc shape having the same curvature as a curvature of the wafer W (not shown in FIG. 19) as an object to be polished, which will be described later.

The pressing tool 12 includes two elastic members 40*a* and 40*b*. The elastic member 40*a* is put on the pressing-tool body 43 with the elastic member 40*a* elastically deformed, while the elastic member 40*a* fits in the fitting groove 45*a*. The elastic member 40*b* is put on the pressing-tool body 43 with the elastic member 40*b* elastically deformed, while the elastic, member 40*b* fits in the fitting groove 45*b*. The elastic, member 40*a* has a portion 41*a* fitting in the fitting groove 45*a*, and the elastic member 40*b* has a portion 41*b* fitting in the fitting groove 45*b*. These portions 41*a* and 41 *b* protrude from the pressing surfaces 44*a* and 44*b* respectively. The portions 41*a* and 41*b* of the elastic members 40*a* and 40*b* are curved inward toward the center line Ct and have the same curvature as the curvature of the wafer W.

The pressing-tool body 43 of the present embodiment has two fitting grooves 60*a* and 60*b* located in a back surface 46 which is an opposite side from the pressing surfaces 44*a* and 44*b*. The fitting grooves 60*a* and 60*b* extend from the side surface 48 to the other side surface 49. The elastic member 40*a* fits in the fitting groove 60*a*, and the elastic member 40*b* fits in the fitting groove 60*b*. As a result, the elastic member 40 is secured stably to the pressing-tool body 43. In one embodiment, the pressing-tool body 43 may have fitting grooves, in which the elastic members 40*a* and 40*b* fit, in the side surface 48 and/or the side surface 49.

The raised portion 43*a* has a tapered surface 56*a* extending obliquely from the pressing surface 44*a*, and the raised portion 43*b* has a tapered surface 56*b* extending obliquely from the pressing surface 44*b*. More specifically, the tapered surface 56*a* extends obliquely from the pressing surface 44*a* toward the base portion 43*c* and is coupled to a side surface 47*a*. The tapered surface 56*b* extends obliquely from the pressing surface 44*b* toward the base portion 43*c* and is coupled to a side surface 50*a*. These tapered surfaces 56*a* and 56*b* can prevent the polishing tape 3 from contacting the pressing-tool body 43 when the elastic members 40*a* and 40*b* press the polishing tape 3 against the wafer W. The coating layer 58 described with reference to FIG. 12 can be applied to the pressing tool 12 of the present embodiment.

Figure 22:
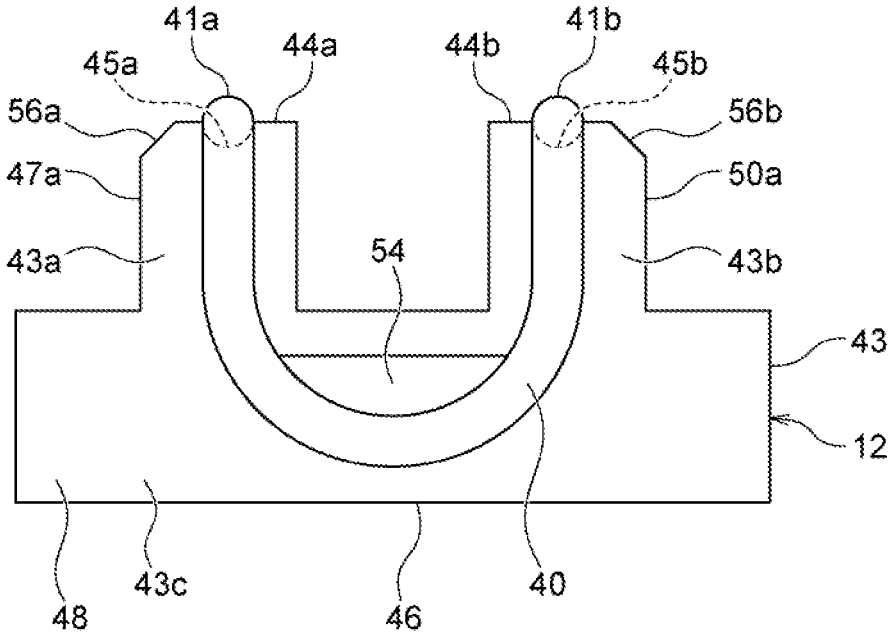
FIG. 22 is a diagram showing another embodiment of the pressing tool described with reference to FIGS. 19 to 21.
Figure 23:
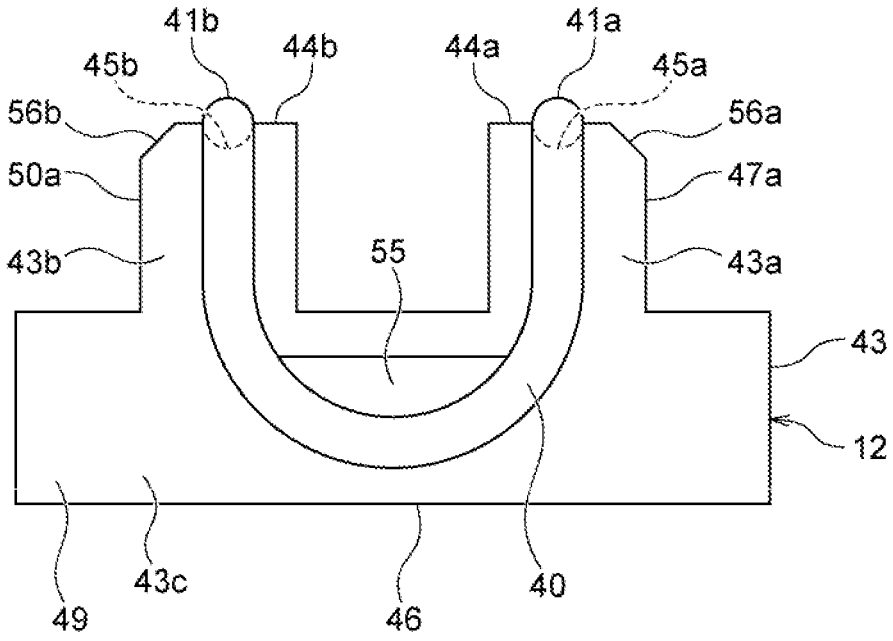
FIG. 23 is a diagram showing another embodiment of the pressing tool described with reference to FIGS. 19 to 21.

FIGS. 22 and 23 are diagrams showing another embodiment of the pressing tool 12 described with reference to FIGS. 19 to 21. FIG. 22 is a diagram of the pressing tool 12 as viewed from the side surface 48. FIG. 23 is a diagram of the polishing tool 12 as viewed from the side surface 49. As shown in FIGS. 22 and 23, the embodiment described with reference to FIGS. 7 to 11 may be applied to the pressing tool 12 described with reference to FIGS. 19 to 21. Details of the pressing tool 12 of the present embodiment, which will not be particularly described are the same as those of the embodiments described with reference to FIGS. 7 to 11 and FIGS. 19 to 21, and duplicated descriptions will be omitted. The pressing-tool body 43 of the present embodiment has a protrusion 54 on the side surface 48, and has a protrusion 55 on the side surface 49. The pressing-tool body 43 does not have the fitting grooves 60*a* and 60*b*. In the present embodiment, the pressing-tool body 43 includes one protrusion 54 and one protrusion 55, while in one embodiment, the pressing-tool body 43 may have two or more protrusions 54 and two or more protrusions 55.

In the present embodiment, the two portions 41*a* and 41*b* fitting in the fitting grooves 45*a* and 45*b*, respectively, can be configured by one elastic member 40. As a result, a cost of replacement parts can be reduced. In addition, since the elastic member 40 of the present embodiment is not supported by the back surface 46 of the pressing-tool body 43, the elastic member 40 can be replaced easily.

Figure 24:
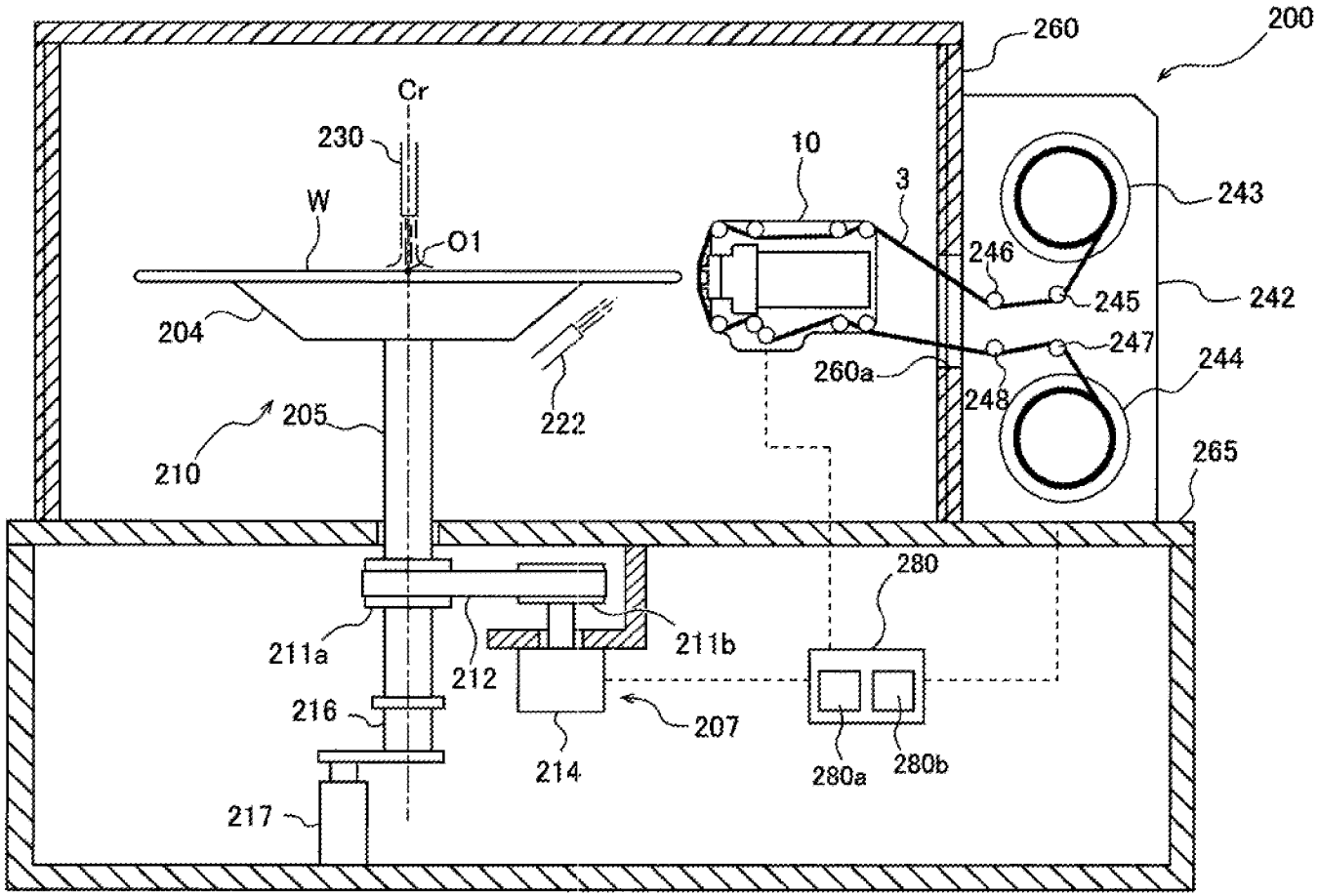
FIG. 24 is a diagram showing an embodiment of the polishing apparatus including the polishing head described with reference to FIGS. 17, and 19 to 23.

FIG. 24 is a diagram showing an embodiment of a polishing apparatus including the polishing head 10 described with reference to FIGS. 17 and 19 to 23. A polishing apparatus 200 shown in FIG. 24 is suitably used as a polishing apparatus that polishes a periphery of a substrate (e.g., a wafer). The polishing apparatus 200 includes a substrate holder 210 configured to hold and rotate a wafer W, which is an object to be polished, polishing head 10 configured to bring a polishing tool into contact with a periphery of the wafer W held by the substrate holder 210 to polish the periphery of the wafer W, a lower supply nozzle 222 configured to supply liquid to a lower surface of the wafer W, and an upper supply nozzle 230 configured to supply liquid onto an upper surface of the wafer W. An example of the liquid supplied to the wafer W includes pure water. During the polishing of the wafer W, the liquid is supplied from the lower supply nozzle 222 to the lower surface of the wafer, and the liquid is supplied from the upper supply nozzle 230 to the upper surface of the wafer W.

FIG. 24 shows the substrate holder 210 holding the wafer W. When the wafer W is held by the substrate holder 210, the polishing head 10 faces the periphery of the wafer W. The substrate holder 210 includes a holding stage 204 configured to hold the wafer W by vacuum suction, a shaft 205 coupled to a central portion of the holding stage 204, and a holding-stage driving mechanism 207 configured to rotate and vertically move the holding stage 204. The holding-stage driving mechanism 207 is configured to be able to rotate the holding stage 204 about its own axis Cr and move the holding stage 204 in a vertical direction along the axis Cr.

The holding stage 204, the polishing head 10, the lower supply nozzle 222, the upper supply nozzle 230, and the holding stage 204 are disposed inside a partition wall 260. The inside of the partition wall 260 constitutes a polishing chamber in which the wafer W is polished. The partition wall 260 is arranged on a base plate 265. The shaft 205 extends through the base plate 265.

The holding-stage driving mechanism 207 includes a motor 214 as a stage rotating device configured to rotate the holding stage 204, and an air cylinder 217 configured to vertically move the holding stage 204. The motor 214 is fixed to a lower surface of the base plate 265. The holding stage 204 is rotated by the motor 214 via the shaft 205, a pulley 211*a* coupled to the shaft 205, a pulley 211*b* attached to a rotating shaft of the motor 214, and a belt 212 put on the pulleys 211*a* and 211*b*. The axis of rotation of the motor 214 extends parallel to the shall 205. With such a configuration, the wafer W held on an upper surface of the holding stage 204 is rotated by the motor 214. The shaft 205 is coupled to the air cylinder 217 via a rotary joint 216 attached to a lower end of the shaft 205, and the shaft 205 and the holding stage 204 can be raised and lowered by the air cylinder 217.

The wafer W is placed on the upper surface of the holding stage 204 by a not-shown transfer mechanism such that the center O1 of the wafer W it on the axis Cr of the holding stage 204. The wafer W is held on the upper surface of the holding stage 204 with a device surface of the wafer W facing upward. With such a configuration, the substrate holder 210 can rotate the wafer W about the axis Cr of the holding stage 204 (i.e., the axis of the wafer W), and can raise and lower the wafer W along the axis Cr of the holding stage 204.

In the present embodiment, a polishing tape 3 having abrasive aims on its surface is used as an example of the polishing tool. The polishing apparatus 200 further includes a polishing-tape supply mechanism 242 configured to supply the polishing tape 3 to the polishing head 10 and configured to collect the polishing tape 3 from the polishing head 10. The polishing-tape supply mechanism 242 is arranged outside the partition wall 260. The polishing-tape supply mechanism 242 includes a tape feeding reel 243 configured to supply the polishing tape 3 to the polishing head 10, and a tape take-up reel 244 configured to collect the polishing tape 3 that has been used for the polishing of the wafer W. Not-shown tension motors are coupled to the tape feeding reel 243 and the tape take-up reel 244, respectively. The tension motors apply a predetermined torque to the tape feeding reel 243 and the tape take-up reel 244, so that a predetermined tension can be generated in the polishing tape 3.

The polishing tape 3 is supplied to the polishing head 10 such that a polishing surface of the polishing tape 3 faces the periphery of the wafer W. The polishing tape 3 is supplied from the tape feeding reel 243 to the polishing head 10 through an opening 260*a* provided in the partition wall 260, and the used polishing tape 3 is collected by the tape take-up reel 244 through the opening 260*a*. The polishing-tape supply mechanism 242 further includes a plurality of guide rollers 245, 246, 247, and 248 for supporting the polishing tape 3. An advancing direction of the polishing tape 3 is guided by the guide rollers 245, 246 247, and 248.

Figure 25:
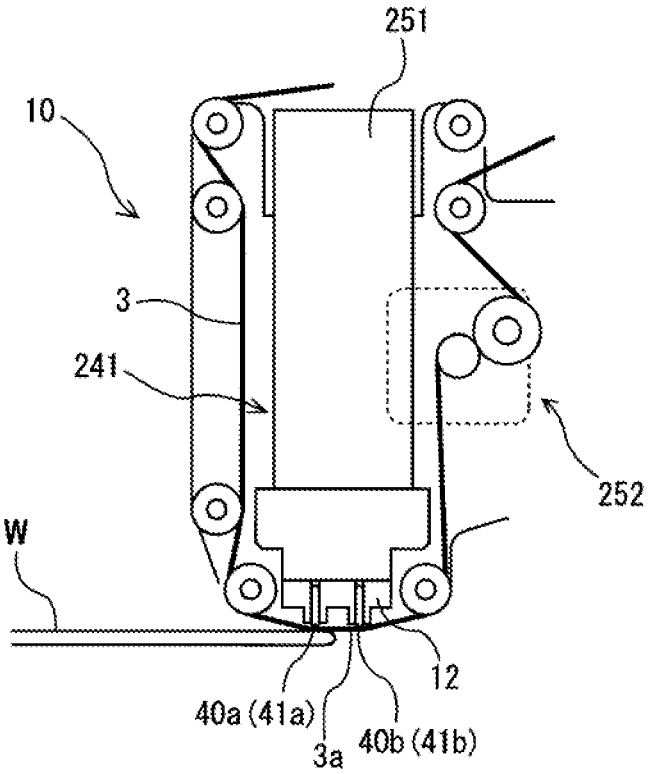
FIG. 25 is a diagram showing the polishing head tilted upward by a tilting mechanism.
Figure 26:
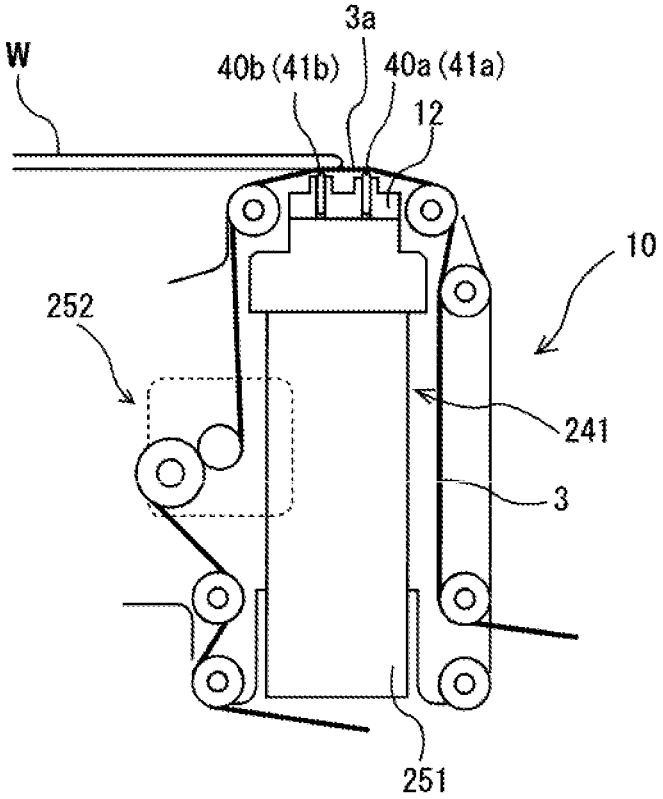
FIG. 26 is a diagram showing the polishing head tilted downward by the tilting mechanism.

The polishing apparatus 200 further includes a not-shown tilting mechanism. The polishing apparatus 200 can polish the periphery of the wafer W while changing a tilt angle of the polishing head 10 by the tilting mechanism. FIG. 25 is a diagram showing the polishing head 10 tilted upward by the tilting mechanism (not shown). FIG. 26 is a diagram showing the polishing head 10 tilted downward by the tilting mechanism.

As shown in FIG. 25, when the polishing head 10 is tilted upward, the portion 41*a* of the elastic member 40*a* is located above the periphery of the wafer W and faces the top-edge portion. As shown in FIG. 26, when the polishing head 10 is tilted downward, the portion 41*b* of the elastic member

40*b* is located below the periphery of the wafer W and faces the bottom-edge portion. When the top-edge portion is to be polished, the polishing surface 3*a* of the polishing tape 3 is pressed against the periphery (i.e., the top-edge portion) of the wafer W by the portion 41*a* of the elastic member 40*a* with the polishing head 10 tilted upward. When the bottom-edge portion is to be polished, the polishing surface 3*a* of the polishing tape 3 is pressed against the periphery (i.e., the bottom-edge portion) of the wafer W by the portion 41*b* with the polishing head 10 tilted downward. Pressing forces of these portions 41*a* and 41*b* can be regulated by the air cylinder 251. During the polishing of the wafer W, a back surface of the polishing tape 3 is supported by the elastic member 40*a* or the elastic member 401.

The polishing apparatus 200 includes an operation controller 280 configured to control operations of each component of the polishing apparatus 200. The polishing head 10, the substrate holder 210, the lower supply nozzle 222, the upper supply nozzle 230, the polishing-tape supply mechanism 242, and the tilting mechanism are electrically coupled to the operation controller 280. The operations of the polishing head 10, the substrate holder 210, the lower supply nozzle 222, the upper supply nozzle 230 the polishing-tape supply mechanism 242, and the tilting mechanism are controlled by the operation controller 280. During the polishing, the operation controller 280 operates the polishing-tape supply mechanism 242 and the tape advancing device 252 to advance the polishing tape 3 in a longitudinal direction thereof with a predetermined speed while a predetermined tension is exerted on the polishing tape 3.

The operation controller 280 is composed of at least one computer. The operation controller 280 includes a memory 280*a* and an arithmetic device 280*b*. The arithmetic device 280*b* includes a CPU (central processing unit), a GPU (graphic processing unit), etc. configured to perform arithmetic operations according to instructions contained in programs stored in the memory 280*a*. The memory 280*a* includes a main memory (e.g., a random-access memory) to which the arithmetic device 280*b* is accessible, and an auxiliary memory (e.g., a hard disk drive or a solid state drive) storing data and the programs therein.

Figure 27:
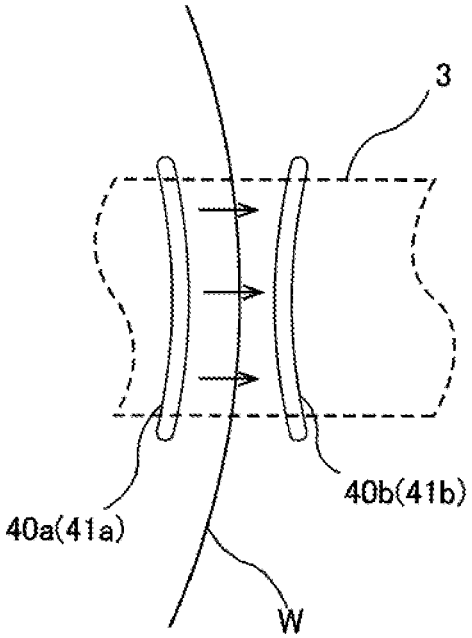
FIG. 27 is a diagram showing a top-edge portion of a wafer being polished.

FIG. 27 is a diagram showing a top-edge portion of the wafer W being polished. The polishing head 10 is moved with a constant speed in a direction indicated by arrows in FIG. 27 (i.e., a radially outward direction of the wafer W) by a moving mechanism constituted of a linear actuator (not shown) or the like, while pressing the polishing tape 3 against the wafer W. The operation of the moving mechanism is controlled by the operation controller 280. In the present embodiment, since the portion 41*a* of the elastic member 40*a* fitting in the fitting groove 45*a* is curved along the periphery of the wafer W, a time when the polishing tape 3 is in contact with the wafer W is uniform over the entire top-edge portion. As a result, the entire top-edge portion can be polished uniformly. In addition, use of the curved portion 41*a* of the elastic member 40*a* can increase a contact length between the polishing tape 3 and the wafer W, and can therefore increase a polishing rate.

Since the fitting groove 45*a* and the fitting groove 45*b* are an tinged symmetrically about the center line Ct, the portion 41*b* extends along the bottom-edge portion of the wafer W when the polishing head 10 is tilted downward such that the portion 41*b* of the elastic member 40*b* faces the bottom-edge portion as shown in FIG. 26. Therefore, as with the polishing of the top-edge portion, the bottom-edge portion can be polished accurately and uniformly by the portion 41*b* of the elastic member 40*b*.

Figure 28:
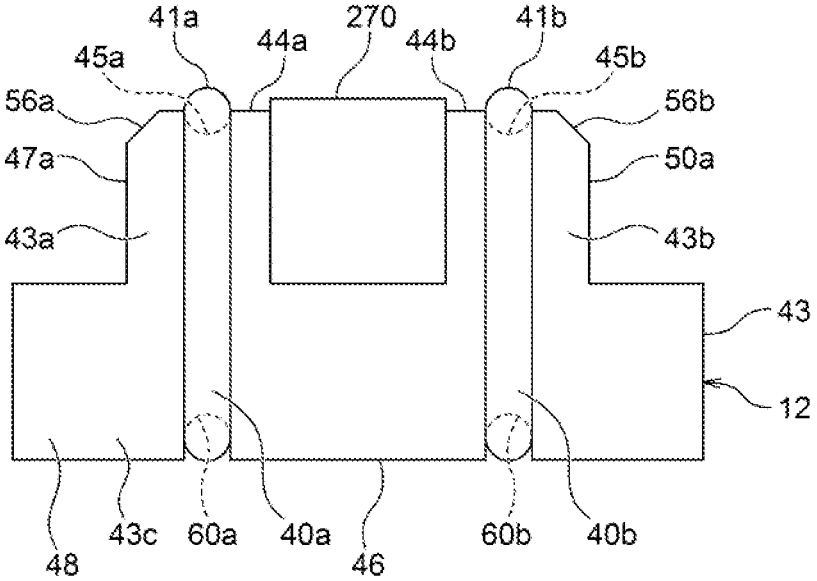
FIG. 28 is a diagram showing another embodiment of the pressing tool.

In one embodiment, as shown in FIG. 28, the pressing tool 12 may further have a pressing (or bevel pad) 270 disposed between the raised portions 43*a* and 43*b*. The pressing pad 270 is made of an elastic closed-cell foam material, such as silicone rubber. When the pressing tool 12 is moved toward the wafer W by the air cylinder 251, the pressing pad 270 presses the polishing tape 3 from its back side against the bevel portion of the wafer W, and the polishing head 10 polishes the bevel portion of the wafer W. In order to reduce friction with the back surface of the polishing tape 3, a sheet whose front surface is covered with fluororesin may be attached to a front surface (pressing surface) of the pressing pad 270. The pressing pad 270 is removable by bolts or the like. The pressing tool 12 of the present embodiment can be applied to the embodiment described with reference to FIGS. 22 and 23.

Figure 29:
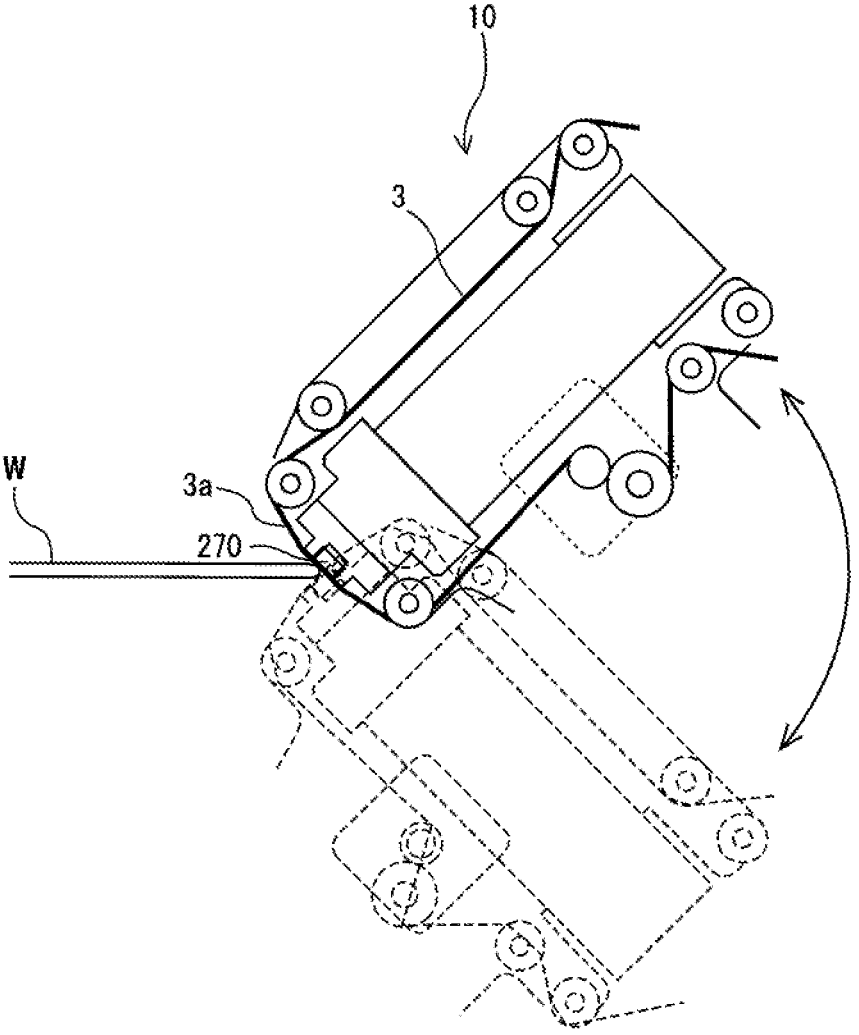
FIG. 29 is a diagram showing a polishing head when polishing a bevel portion of a wafer W.

FIG. 29 is a diagram showing the polishing head 10 when polishing the bevel portion of the wafer W. When the periphery of the wafer W is polished, as shown in FIG. 29, the polishing tape 3 is pressed against the periphery (e.g., the bevel portion) of the wafer W by the pressing mechanism 241 while the tilt angle of the polishing head 10 is continuously changed by the tilting mechanism (not shown).

Further, in one embodiment, when the polishing head 10 polishes any one of the top-edge portion and the bottom-edge portion, the pressing-tool body 43 may include only one of the two raised portions 43*a* and 43*b*, and may include only one of the two elastic members 40*a* and 40*b*. Further, in one embodiment, the polishing apparatus 200 may include a plurality of polishing heads 10 arranged in a circumferential direction of the holding stage 204.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

INDUSTRIAL APPLICABILITY

The present invention is applicable to a polishing head for pressing a polishing tool against a substrate, such as a wafer. Further, the present invention is applicable to a polishing apparatus for polishing the substrate with such a polishing head.

REFERENCE SIGNS LIST

1 first surface
2 second surface
3 polishing tape
10 polishing head
10A, 10B polishing, head
11A, 11B polishing-head assembly
12 pressing tool
15 movable shaft
18 housing
18A housing body
18B lid
20 pressure chamber
25 partition membrane
30 ball spline nut
31 screw
33 compressed-gas flow passage

35 switching valve
36 pressure regulator
38 compressed-gas supply source
40 elastic member
41 portion
43 pressing-tool body
44 pressing surface
45 fitting groove
46 back surface
47, 48, 49, 50 side surface
51 filling groove
52 portion
54, 55 protrusion
56*a*, 56*b* tapered surface
58 coating layer
60*a*, 60*b* fitting groove
65 distance sensor
67 universal joint
71 skirt
100 polishing apparatus
110 substrate holder
111 roller
112 roller-rotating mechanism
120 movable plate
127 rinsing-liquid supply nozzle
128 protecting-liquid supply nozzle
131 support member
131A, 131B support member
141 polishing-tape supply mechanism
141A, 141B polishing-tape supply mechanism
142 reel base
143 tape feeding reel
143*a*, 144*a* tension motor
144 tape take-up reel
146 tape advancing device
146A, 146B tape advancing device
147 tape feeding motor
148 tape advancing roller
149 nip roller
153*a*, 153*b*, 153*c*, 153*d* guide roller
180 operation controller
191 polishing-head moving mechanism
193 ball-screw mechanism
194 motor
195 linear-motion guide
200 polishing apparatus
204 holding stage
205 shaft
207 holding-stage driving mechanism
210 substrate holder
214 motor
217 air cylinder
222 lower supply nozzle
230 upper supply nozzle
241 pressing mechanism
242 polishing-tape supply mechanism
243 tape feeding reel
244 tape take-up reel
245, 246, 247, 248 guide roller
751 air cylinder
252 tape advancing device
253, 254, 255, 256, 257, 258, 259 guide roller
260 partition wall
265 base plate
270 pressing pad
280 operation controller
353*a*, 353*b*, 353*c*, 353*d* guide roller
453*a*, 45M, 453*c*, 453*d* guide roller

The invention claimed is:

1. A polishing head for polishing a substrate, comprising:
an annular elastic member configured to press a polishing tool against the substrate; and
a pressing-tool body having a pressing surface configured to press the polishing tool against the substrate via the elastic member,
wherein a first portion of the elastic member is inset into the a first fitting groove of the pressing surface, the first portion being in tight contact with the first fitting groove and being out of contact with a region of the pressing surface other than the first fitting groove,
the first portion protrudes from the pressing surface,
the elastic member is put on the pressing-tool body with the elastic member elastically deformed, and
the polishing head the first portion in the first fitting groove is configured to press the polishing tool against the substrate by the first portion.

2. The polishing head according to claim 1, wherein the elastic member is detachably put on the pressing-tool body.

3. The polishing head according to claim 1, wherein the elastic member has a circular cross section.

4. The polishing head according to claim 3, wherein the first fitting groove has a semi-circular cross section in tight contact with the circular cross section of the first portion.

5. The polishing head according to claim 1, wherein the elastic member is covered with a coating layer containing a fluororesin.

6. The polishing head according to claim 1, wherein the pressing-tool body further has a tapered surface extending obliquely from the pressing surface.

7. The polishing head according to claim 1, wherein a side surface of the pressing-tool body has a second fitting groove in which a second portion of the elastic member fits, the side surface being separated from the pressing surface, and the second fitting groove extending in a longitudinal direction of the polishing tool.

8. The polishing head according to claim 1 wherein the pressing-tool body has a protrusion on a side surface of the pressing-tool body, the side surface being separated from the pressing surface, and
the protrusion supports the elastic member.

9. The polishing head according to claim 1, wherein
the first fitting groove comprises a plurality of first fitting grooves located away from each other, and
the first portion comprises a plurality of first portions fitting in the plurality of first fitting grooves, respectively.

10. The polishing head according to claim 1, wherein the first fitting groove has an arc shape having the same curvature as a curvature of the substrate.

11. A polishing apparatus comprising:
a substrate holder configured to hold a substrate; and
the polishing head, according to claim 1, configured to press a polishing tool against the substrate to polish the substrate.

12. The polishing head according to claim 1, wherein the first portion has a convex cross section, and the first fitting groove has a concave cross section that conforms with the convex cross section of the first portion and is in tight contact with the convex cross section of the first portion.

13. The polishing head according to claim 1, wherein a longitudinal direction of the first portion is parallel with the first fitting groove.

14. The polishing head according to claim 1, wherein the first portion and the first fitting groove extend obliquely across the pressing surface.

* * * * *